US005230992A

United States Patent [19]

Miyahashi et al.

[11] Patent Number: 5,230,992

[45] Date of Patent: Jul. 27, 1993

[54] SILVER HALIDE COLOR PHOTOGRAPHIC MATERIAL

[75] Inventors: Keiji Miyahashi; Morio Yagihara, both of Kanagawa, Japan

[73] Assignee: Fuji Photo Film Co., Ltd., Kanagawa, Japan

[21] Appl. No.: 877,398

[22] Filed: Apr. 30, 1992

Related U.S. Application Data

[63] Continuation of Ser. No. 280,041, Dec. 5, 1988, abandoned.

[30] Foreign Application Priority Data

Dec. 3, 1987 [JP] Japan ..... 62-306295

[51] Int. Cl.[5] ..... G03C 1/46; G03C 1/34

[52] U.S. Cl. ..... 430/505; 430/551

[58] Field of Search ..... 430/264, 551, 598, 505

[56] References Cited

U.S. PATENT DOCUMENTS

| | | | |
|---|---|---|---|
| 4,390,618 | 6/1983 | Kobayashi et al. | 430/543 |
| 4,746,601 | 5/1988 | Mihayashi et al. | 430/543 |
| 4,871,653 | 10/1989 | Inoue et al. | 430/409 |
| 4,873,173 | 10/1989 | Sasaoka et al. | 430/598 |
| 4,923,787 | 5/1990 | Harder | 430/598 |

FOREIGN PATENT DOCUMENTS 62-27731 2/1987 Japan .

*Primary Examiner*—Janet C. Baxter
*Attorney, Agent, or Firm*—Sughrue, Mion, Zinn, Macpeak & Seas

[57] ABSTRACT

A silver halide color photographic material composed of a support having thereon at least one silver halide emulsion layer sensitive to red light containing a cyan coupler; at least one silver halide emulsion layer sensitive to green light containing a magenta coupler; at least one silver halide emulsion layer sensitive to blue light containing a yellow coupler; and at least one non-light-sensitive layer; at least one layer thereof containing at least one nondiffusible, non-color-forming compound represented by formula (I):

(I)

wherein $R^{11}$, $R^{12}$ and $R^{13}$, which may be the same or different, each represents hydrogen, an aliphatic group or an aromatic group; $R^{14}$ represents hydrogen, an alkyl group, an aralkyl group, an aryl group, a heterocyclic group, an alkoxy group, an aryloxy group, an amino group, an alkoxycarbonyl group, an aryloxycarbonyl group or a carbamoyl group; $G^{11}$ represents a carbonyl group, a sulfonyl group, a sulfinyl group, a group, or an iminomethylene group; and n is 0 or 1.

13 Claims, No Drawings

SILVER HALIDE COLOR PHOTOGRAPHIC MATERIAL

This is a continuation of application Ser. No. 07/280,041, filed Dec. 5, 1988, now abandoned.

FIELD OF THE INVENTION

This invention concerns silver halide color photographic materials and, more precisely, the invention concerns photosensitive materials which contain hydrazine based compounds, which are improved in color staining and color fogging, which have improved graininess and sharpness, and which have improved storage properties.

BACKGROUND OF THE INVENTION

The occurrence of undesirable color staining between layers of different color sensitivity in silver halide color photosensitive materials is well known in the art. Methods in which hydroquinone based compounds are used have been suggested in U.S. Pat. Nos. 2,336,327 and 4,277,553, as a means of preventing the occurrence of this color staining. These compounds do indeed have some effect in preventing the occurrence of staining, but the effect is slight and there are problems, in that colored materials are produced after these compounds have exercised their anti-color staining effect, and in that changes occur in photographic performance during the manufacture and storage of the sensitive material.

On the other hand, coupler compounds which release compounds by means of a reaction with the oxidized form of a color developing agent have been suggested in U.S. Pat. No. 4,390,618. Furthermore, JP-A-62-27731 (the term "JP-A" as used herein refers to a "published unexamined Japanese patent application") discloses diffusible compounds that must interact with the silver halide emulsion.

SUMMARY OF THE INVENTION

An object of the invention is to provide photosensitive materials in which color staining and color fogging are slight, and which have excellent color reproduction properties. Another object of the invention is to provide photosensitive materials which exhibit little change in the photographic performance during manufacture and storage. A further object of the invention is to provide photosensitive materials which have excellent graininess. Still another object of the invention is to provide photosensitive materials which have excellent sharpness.

It has now been found that these and other objects of the invention can be attained by a silver halide color photographic material comprising a support having thereon at least one silver halide emulsion layer sensitive to red light containing a cyan coupler; at least one silver halide emulsion layer sensitive to green light containing a magenta coupler; at least one silver halide emulsion layer sensitive to blue light containing a yellow coupler; and at least one non-light-sensitive layer; at least one layer thereof containing at least one nondiffusible, non-color-forming compound represented by formula (I):

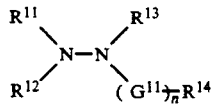

(I)

wherein $R^{11}$, $R^{12}$ and $R^{13}$, which may be the same or different, each represents hydrogen, an aliphatic group or an aromatic group; $R^{14}$ represents hydrogen, an alkyl group, an aralkyl group, an aryl group, a heterocyclic group, an alkoxy group, an aryloxy group, an amino group, an alkoxycarbonyl group, an aryloxycarbonyl group or a carbamoyl group; $G^{11}$ represents a carbonyl group, a sulfonyl group, a sulfinyl group, a

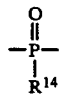

group, or an iminomethylene group

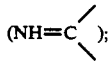

and n is 0 or 1.

DETAILED DESCRIPTION OF THE INVENTION

In silver halide color photosensitive materials according to the invention, the compound which is represented by formula (I) is preferably included in the non-photosensitive layer.

The compounds represented by formula (I) are described in greater detail below.

The aliphatic groups represented by $R^{11}$, $R^{12}$ and $R^{13}$ preferably have from 1 to 30 carbon atoms and they are preferably linear chain, branched or cyclic alkyl groups which have from 1 to 20 carbon atoms. Here, the branched alkyl group may be cyclized to form a saturated heterocyclic ring which contains one or more hetero atoms. Furthermore, the alkyl group may have substituent groups, such as aryl groups, for example, phenyl, naphthyl group, alkoxy groups, for example, methoxy, ethoxy, methoxyethoxy group, sulfoxy groups, sulfonamido groups, or carbonamido groups.

Specific examples of the aliphatic groups include t-butyl, n-octyl, t-octyl, cyclohexyl, pyrrolidyl, imidazolyl, tetrahydrofuryl, and morpholinyl group.

The aromatic groups represented by $R^{11}$, $R^{12}$ and $R^{13}$ are single ring or double ring aryl groups or unsaturated heterocyclic groups having 1 to 32 carbon atoms. Here, the unsaturated heterocyclic groups may be condensed with a single ring or double ring aryl group to form a heteroaryl group.

Examples include benzene, naphthalene, pyridine, pyrimidine, imidazole, pyrrolazole, quinoline, isoquinoline, benzimidazole, thiazole, benzothiazole. Of these, benzene is preferred.

The phenyl group is especially preferred. The aryl groups or unsaturated heterocyclic groups of $R^{11}$, $R^{12}$ and $R^{13}$ may have substituent groups. Typical substituent groups include, for example, $C_1$–$C_{20}$ alkyl groups, $C_7$–$C_{20}$ aralkyl groups, $C_1$–$C_{20}$ alkoxy groups, $C_6$–$C_{20}$ aryl groups, substituted $C_1$–$C_{20}$ amino groups, $C_{20}$ or less acylamino groups, $C_{20}$ or less sulfonylamino groups, $C_{20}$ or less ureido groups, $C_{20}$ or less urethane groups, $C_6$–$C_{20}$ aryloxy groups, $C_1$–$C_{20}$ sulfamoyl groups, $C_1$–$C_{20}$ carbamoyl groups, $C_6$–$C_{20}$ aryl groups, $C_1$–$C_{20}$ alkylthio groups, $C_6$–$C_{20}$ arylthio groups, $C_1$–$C_{20}$ sulfonyl groups, $C_1$–$C_{20}$ sulfinyl groups, hydroxyl groups, halogen atoms, cyano groups, sulfo groups and $C_1$–$C_{20}$ carbosyl groups, etc.

The preferred alkyl groups represented by $R^{14}$ have from 1 to 30 carbon atoms and they may be linear chain, branched or cyclic alkyl groups. Specific examples include methyl, ethyl, butyl, t-butyl, cyclohexyl, octyl, dodecyl, and octadecyl groups. The preferred aralkyl groups have from 7 to 30 carbon atoms and examples include benzyl, phenethyl, and naphthylmethyl groups. The preferred aryl groups have from 6 to 30 carbon atoms and examples include phenyl, naphthyl groups. The preferred heterocyclic groups have from 1 to 12 carbon atoms and examples include imidazolyl and pyridyl groups. The preferred alkoxy groups have from 1 to 30 carbon atoms and examples include methoxy, ethoxy, octyloxy, dodecyloxy, benzyloxy, and cyclohexyloxy groups. The preferred aryloxy groups have from 6 to 30 carbon atoms and examples include phenoxy, naphthoxy groups. The preferred amino groups have from 0 to 30 carbon atoms, and examples include unsubstituted amino, methylamino, and phenylamino groups. The preferred alkoxycarbonyl groups have from 1 to 30 carbon atoms, including ethoxycarbonyl, octyloxycarbonyl, dodecyloxycarbonyl, and benzyloxycarbonyl groups. The preferred aryloxycarbonyl groups have from 6 to 30 carbon atoms, being, for example, phenoxycarbonyl and naphthyloxycarbonyl groups, and the preferred carbamoyl groups have from 1 to 30 carbon atoms, including carbamoyl, N,N-diethylcarbamoyl, and phenylcarbamoyl groups. The alkyl groups, aralkyl groups, aryl groups, heterocyclic groups, alkoxy groups, aryloxy groups, amino groups and carbamoyl groups represented here by $R^{14}$ may have substituent groups, and specific examples of these groups are the same as those described above as substituent groups for $R^{11}$, $R^{12}$ and $R^{13}$.

Moreover, those compounds represented by formula (I) which are represented by formula (II) are preferred.

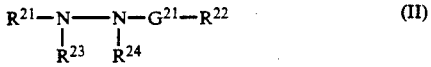

(II)

In this formula $R^{21}$ represents an aliphatic group, an aromatic group or a heterocyclic group having $C_1$–$C_{20}$, $R^{22}$ represents hydrogen, $C_1$–$C_{30}$ alkyl, $C_1$–$C_{30}$ aralky, $C_6$–$C_{30}$ aryl, $C_1$–$C_{30}$ alkoxy, $C_6$–$C_{30}$ aryloxy or $C_1$–$C_{30}$ amino groups, $G^{21}$ represents carbonyl, sulfonyl, or sulfinyl having $C_1$–$C_{30}$,

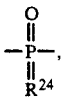

or $C_2$–$C_{30}$ iminomethylene groups

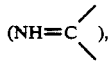

$R^{23}$ and $R^{24}$, which may be the same or different, each represents hydrogen atoms, or one represents hydrogen and the other represents $C_1$–$C_{30}$ alkylsulfonyl, $C_6$–$C_{30}$ arylsulfonyl or $C_1$–$C_{30}$ acyl group. $G^{21}$, $R^{23}$, $R^{24}$ and the hydrazine nitrogen may be linked to form a hydrazone structure

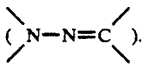

Furthermore, where possible, the groups described above may be substituted with substituent groups.

In more detail, $R^{21}$ may be substituted with substituent groups, and examples include the same substituent groups as described as substituents for $R^{11}$, $R^{12}$, $R^{13}$ and $R^{14}$ in formula (I). Preferred substituent groups are $C_0$–$C_{20}$ ureido, $C_1$–$C_{20}$ alkoxy, $C_1$–$C_{20}$ alkyl, $C_1$–$C_{20}$ acylamino, $C_1$–$C_{20}$ substituted amino, $C_1$–$C_{20}$ sulfonylamino, $C_1$–$C_{20}$ urethane, $C_6$–$C_{20}$ aryloxy and hydroxyl groups.

Furthermore, where possible, these substituent groups may be joined together to form a ring.

$R^{21}$ is preferably an aryl group, an aromatic heterocyclic group or an aryl substituted methyl group, and it is most desirably an aryl group (for example, phenyl and naphthyl groups).

$R^{22}$ is preferably hydrogen, an alkyl group (for example, methyl group), or an aralkyl group (for example, hydroxybenzyl group), and it is most preferably hydrogen.

The aforementioned substituent groups described in connection with $R^{11}$, $R^{12}$, $R^{13}$ and $R^{14}$ can be used as substituent groups for $R^{22}$, and examples of substituent groups which can be used include acyl, acyloxy, alkyl- or aryloxycarbonyl, alkenyl, alkynyl and nitro groups.

These substituent groups may be further substituted with these substituent groups. Furthermore, where possible, these substituent groups may be joined together to form rings.

$R^{21}$ may contain a ballast group normally used in immobile, photographically useful additives such as couplers. A ballast group is a group which has at least 8 carbon atoms and which is comparatively inactive photographically, and it may be selected from among, for example, alkyl, alkoxy, phenyl, alkylphenyl, phenoxy, amino, ureido, urethane, sulfonamido and thioether groups, and groups consisting of combinations of these groups. The total number of carbon atoms in $R^{21}$ and $R^{22}$ is preferably at least 13, and most desirably the total number of carbon atoms in 1 and $R^{22}$ is from 20 to 60.

Alternatively, $R^{21}$ may contain a group which is strongly adsorbed on the surface of silver halide grains. Adsorption groups of this type include thiourea, heterocyclic thioamido, mercapto heterocyclic, and triazole groups, disclosed in U.S. Pat. Nos. 4,385,108 and 4,459,347, and in JP-A-59-195233, JP-A-59-200231, JP-A-59-201045, JP-A-59-201046, JP-A-59-201047, JP-A-59-201048, JP-A-59-201049, JP-A-60-179734, JP-A-61-170773 and JP-A-62-948.

The preferred groups are noncyclic thioamide groups (for example, thioureido, thiourethane), cyclic thioamide groups (mercapto substituted nitrogen containing heterocycles, such as, for example, 2-mercaptothiadiazole, 3-mercapto-1,2,4-triazole, 5-mercaptotetrazole, 2-mercapto-1,3,4-oxadiazole, 2-mercaptobenzoxazole), and nitrogen containing heterocyclic groups (for example, benzotriazole, benzimidazole, imidazole).

The incorporation of ballast groups is more preferred.

$R^{23}$ and $R^{24}$ may be hydrogen, alkylsulfonyl and arylsulfonyl groups which have not more than 20 carbon atoms (phenylsulfonyl and substituted phenylsulfonyl groups in which the sum of the Hammett substituent constants is at least −0.5 are preferred), or acyl groups which have not more than 20 carbon atoms (benzoyl, substituted benzoyl groups in which the sum of the Hammett substituent constants is at least −0.5, or linear chain, branched or cyclic unsubstituted or substituted aliphatic acyl groups which have, for example, halogen, ether, sulfonamido, carbonamido, hydroxyl, carboxyl, sulfonic acid groups as substituent groups) are preferred.

$R^{23}$ and $R^{24}$ are most preferably hydrogen atoms. The group represented by $-G^{21}-R^{22}$ is, for example, formyl, acyl groups (acetyl, propionyl, trifluoroacetyl, chloroacetyl, benzoyl, 4-chlorobenzoyl, pyruvoyl, methoxalyl, and methyloxamoyl groups), alkylsulfonyl group (methanesulfonyl, 2-chloroethanesulfonyl groups), arylsulfonyl group (benzenesulfonyl group), alkylsulfinyl group (methanesulfinyl group), arylsulfinyl group (benzenesulfinyl group), carbamoyl group (methylcarbamoyl, phenylcarbamoyl group), sulfamoyl group (dimethylsulfamoyl group), alkoxycarbonyl group (methoxycarbonyl, methoxyethoxycarbonyl group), aryloxycarbonyl group (phenoxycarbonyl group), sulfinamoyl group (methylsulfinamoyl group), alkoxysulfonyl group (methoxysulfonyl, ethoxysulfonyl group), thioacyl group (methylthiocarbonyl group), thiocarbamoyl group (methylthiocarbamoyl group) or heterocyclic group (pyridyl group). Formyl and acyl groups are especially preferred.

In general formula (II), a hydrazone structure

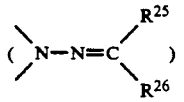

may be formed by connecting $G^{21}$, $R^{23}$, $R^{24}$ and the hydrazine nitrogen.

In this structure, $R^{25}$ represents alkyl, aryl or heterocyclic groups, and $R^{26}$ represents hydrogen, alkyl, aryl or heterocyclic groups.

Exemplary compounds 1 to 68 which can be represented by formula (I) are indicated below. Of these, the compounds 1 to 35 are preferred. However, the invention is not to be construed as being limited to these compounds.

1

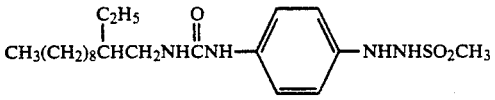

2

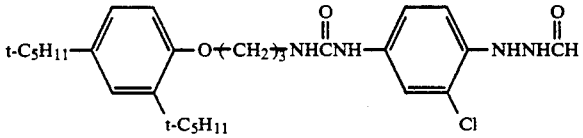

3

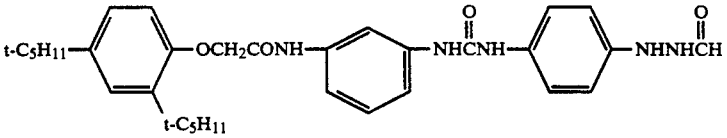

4

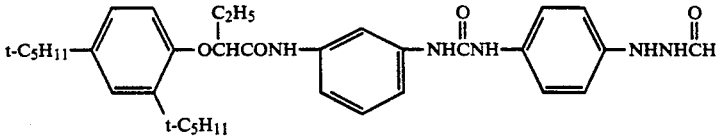

5

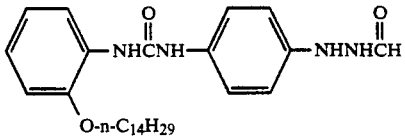

-continued
6
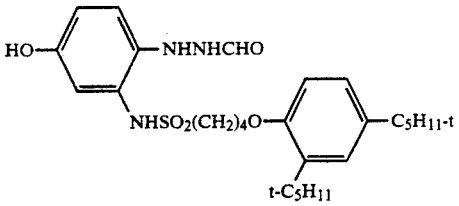
7
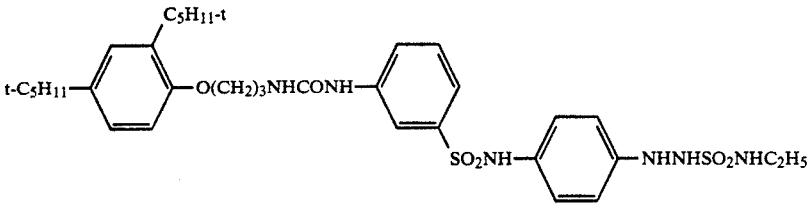
8
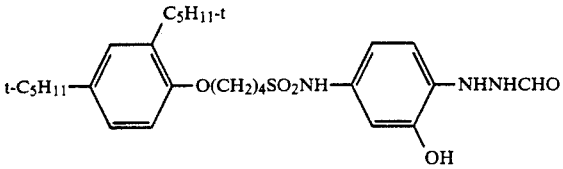
9
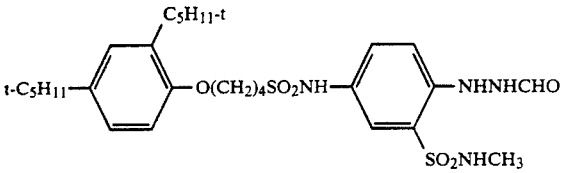
10
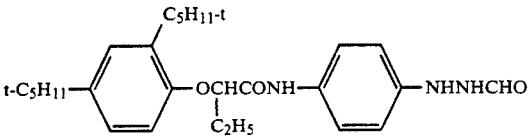
11
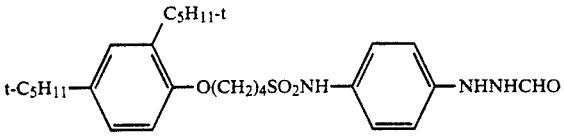
12
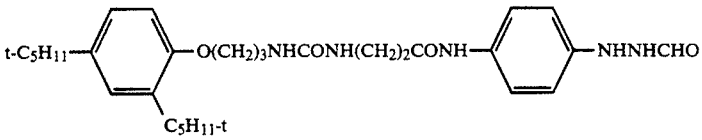
13
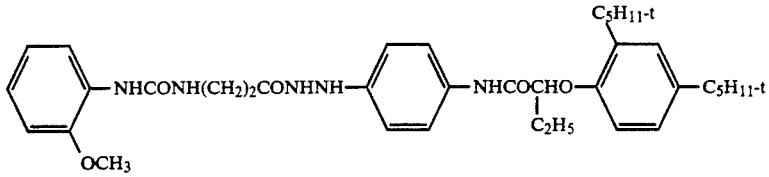
14
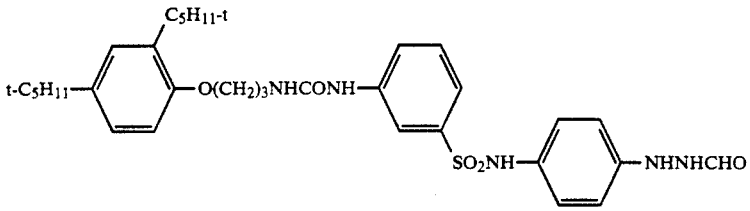

-continued
15
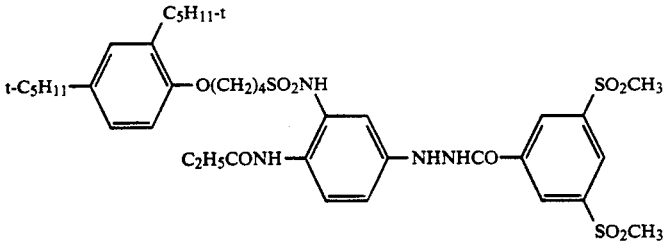
16
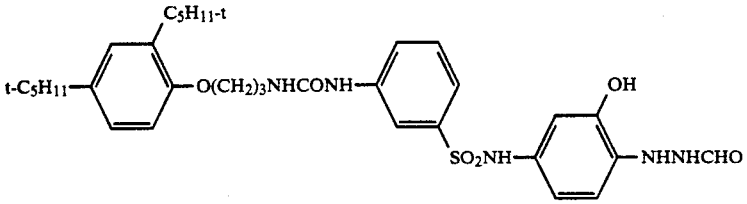
17
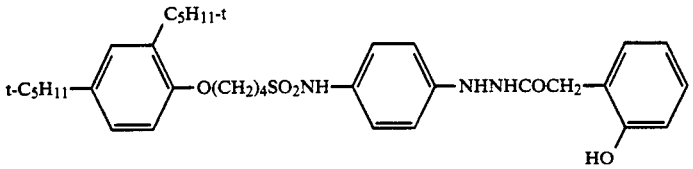
18
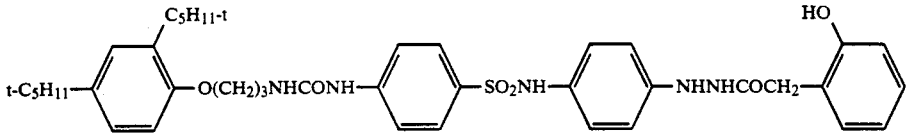
19
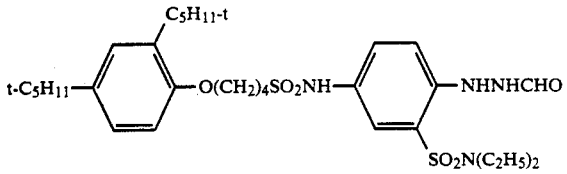
20
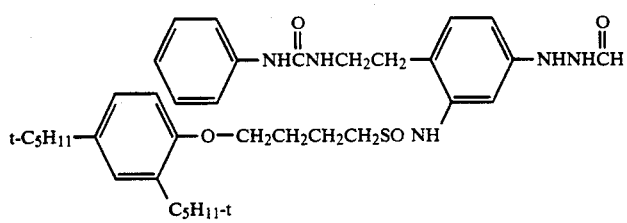
21
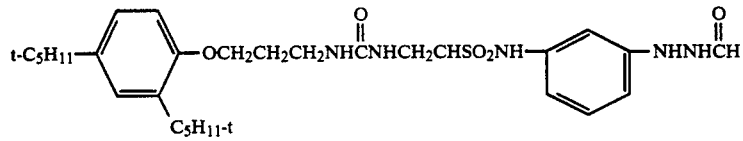
22
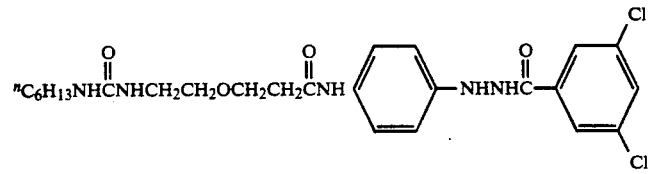
23
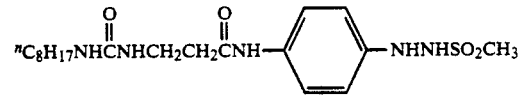

-continued
24
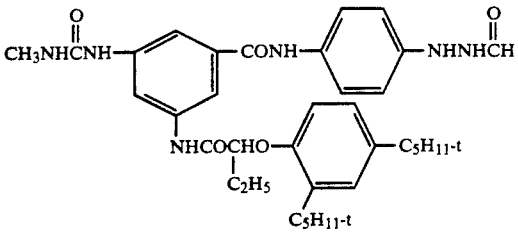
25
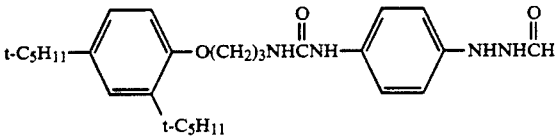
26
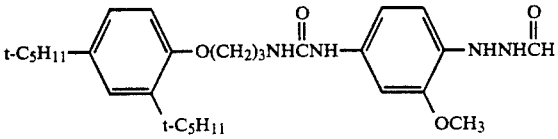
27
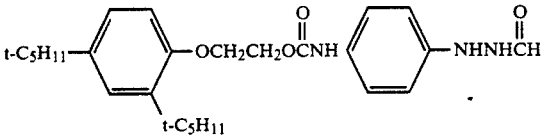
28
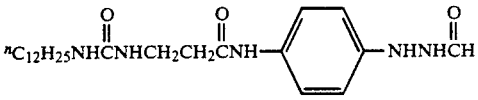
29
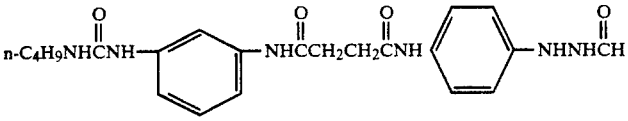
30
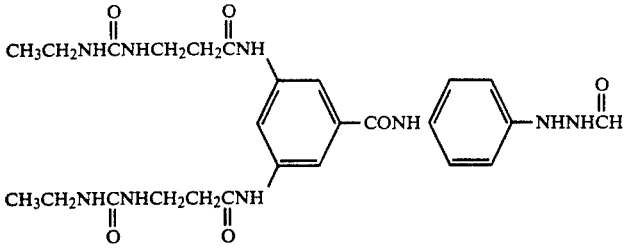
31
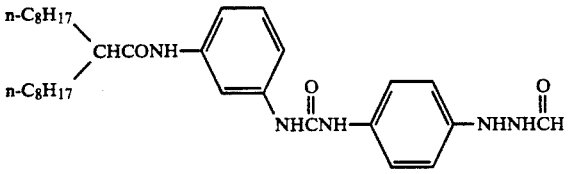
32
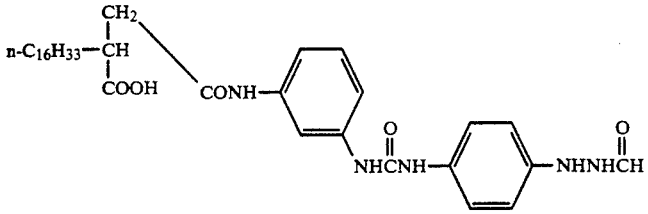

-continued
33
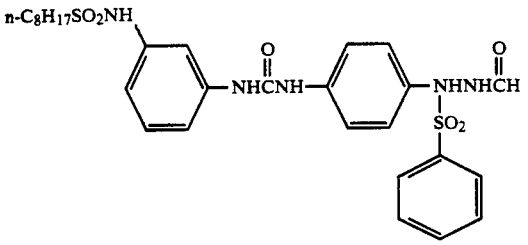
34
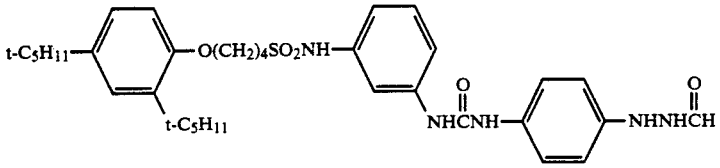
35
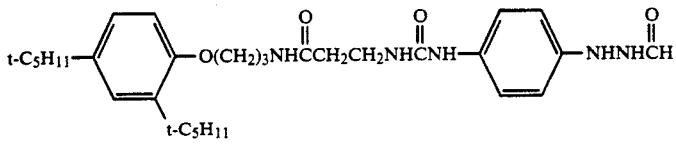
36
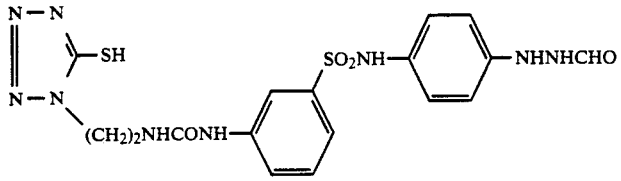
37
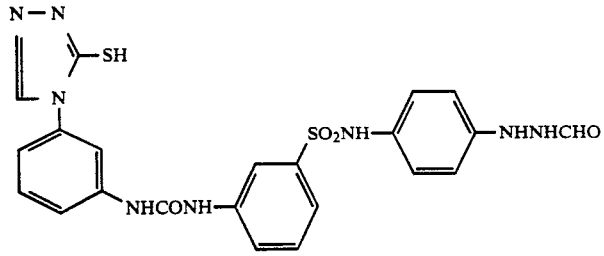
38
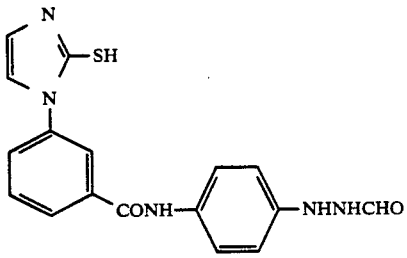
39
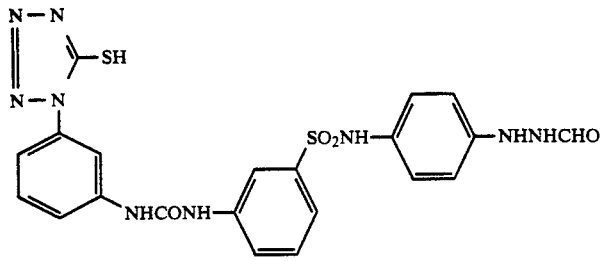

-continued
40
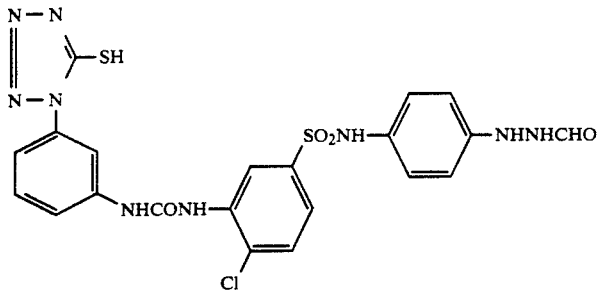
41
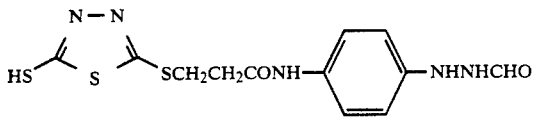
42
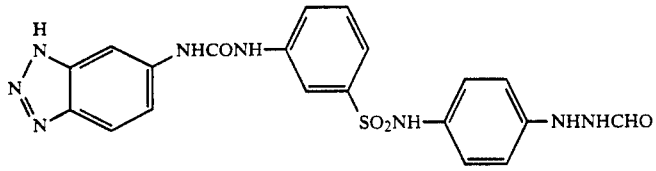
43
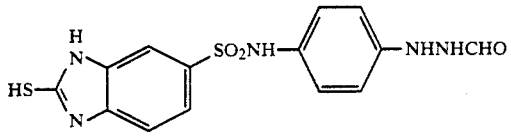
44
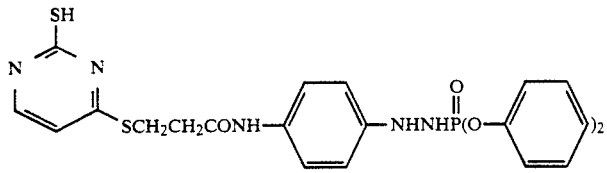
45
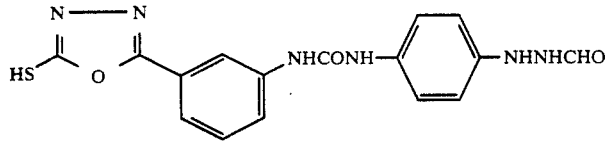
46
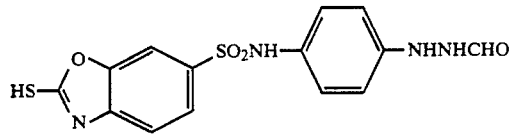
47
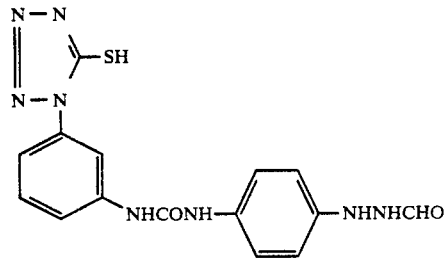

-continued
48
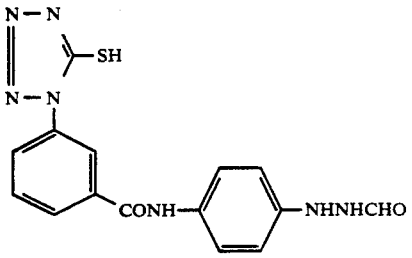
49
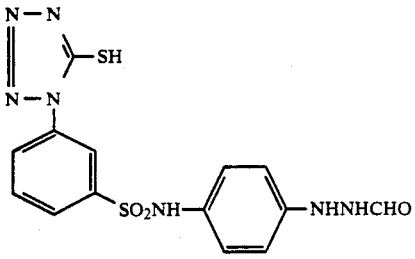
50
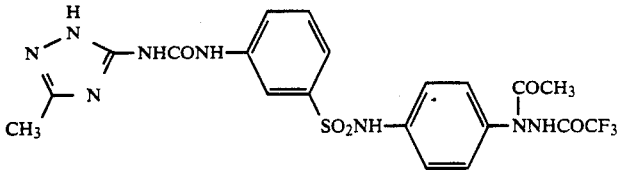
51
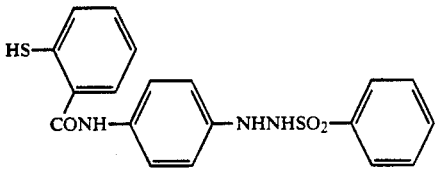
52
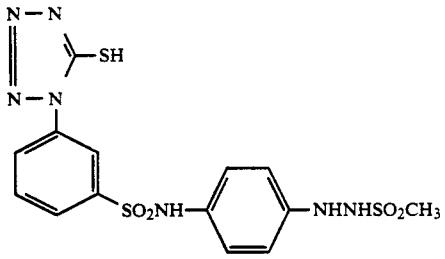
53
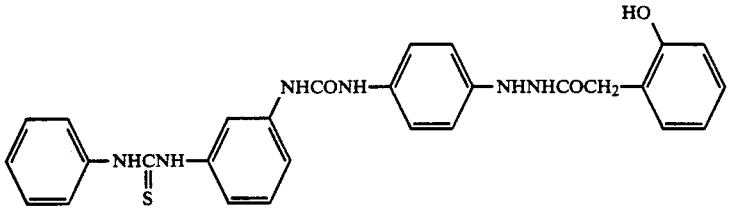
54
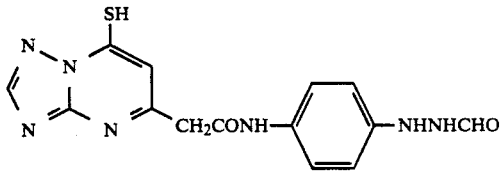

-continued
55
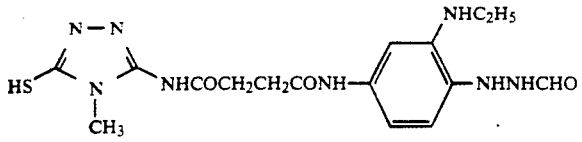
56
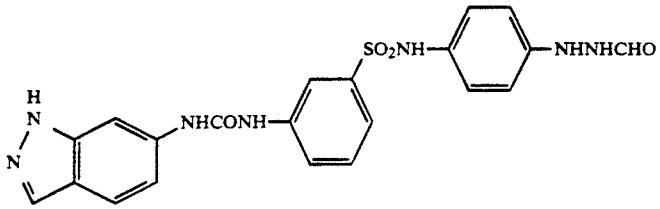
57
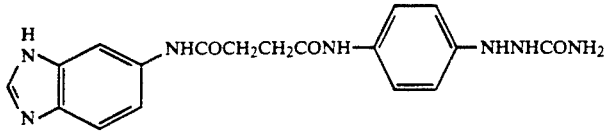
58
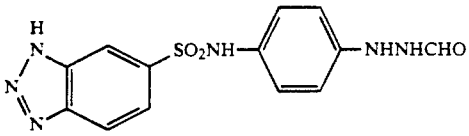
59
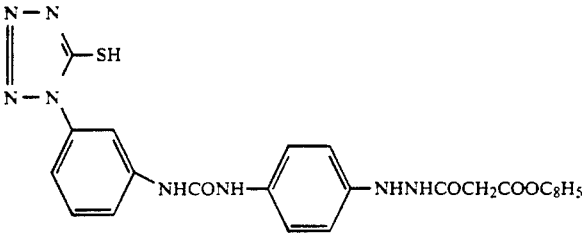
60
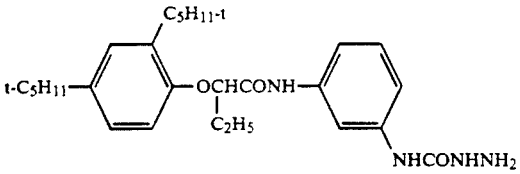
61
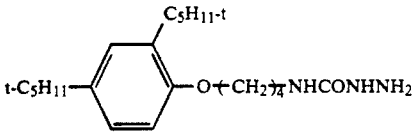
62
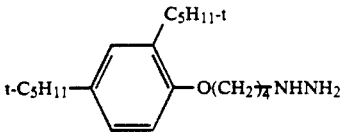
63
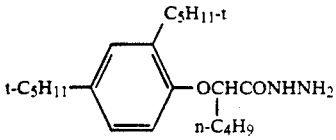

-continued

64

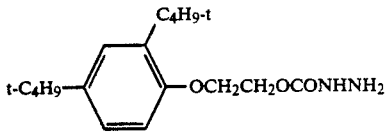

65

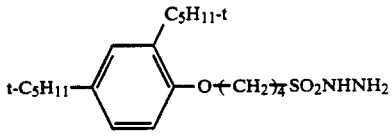

66

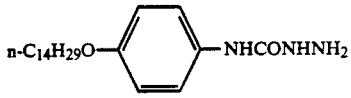

67

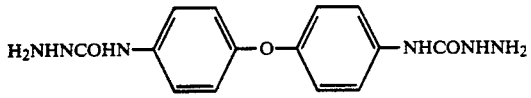

68

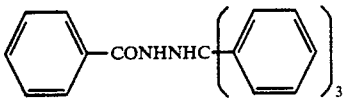

These compounds and methods for their synthesis have been disclosed, for example, in JP-A-57-86829, U.S. Pat. Nos. 4,560,638, 4,478,928, 2,563,785 and 2,588,982, in JP-A-56-67843, in U.S. Pat. Nos. 4,030,925, 4,080,207, 4,031,127, 3,718,470, 4,269,929, 4,276,364, 4,278,748, 4,385,108, 4,459,347, 4,478,928 and 4,560,632, in British Patent 2,011,391B, in JP-A-54-74729, JP-A-55-163533, JP-A-55-74536, JP-A-60-179734, JP-A-61-236548, JP-A-61-270744, 62-270948, 63-234244, 63-234245, 63-234246, 63-223744 and 63-121838.

The compounds represented by general formula (I) of this invention (referred to below as compounds of this invention) are non-color-forming. As used herein this term means that they do not have coupler residual groups which couple with the oxidized form of a primary aromatic amine developing agent and form a colored or colorless dye. Furthermore, no redox residual group which undergoes a redox reaction with the oxidized form of a primary aromatic amine developing agent is included in the groups $R^{11}$, $R^{12}$, $R^{13}$, $R^{14}$ or $G^{11}$ of formula (I).

Acidic groups such as carboxylic acids and sulfonic acids may be present in the compounds of this invention.

The compounds of this invention must be non-diffusible, and the molecular weight per

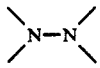

unit is at least 300 but not more than 2,000, preferably at least 400 but not more than 1,200, more desirably at least 450 but not more than 1,000 and most desirably at least 500 but not more than 800.

Two or more compounds of this invention can be used in combination.

The compounds of this invention can be included in at least one of the protective layers, photosensitive silver halide emulsion layers, nonphotosensitive fine grained silver halide emulsion layers, intermediate layers, filter layers, undercoating layers, or anti-halation layers of a photosensitive material which are not restricted to be in this order, but they are preferably included in the photosensitive emulsion layers and/or the intermediate layers between two photosensitive layers (which may have the same or different color sensitivity), and most desirably they are used in the intermediate layers.

When the compounds of this invention are added to a nonphotosensitive layer, the coated weight of gelatin in the nonphotosensitive layer is suitably between about 0.2 and about 2.0 g per square meter, preferably between about 0.3 and about 1.2 g per square meter, and most preferably between about 0.4 and about 1.0 g per square meter.

The addition of the compounds of this invention to these layers can be achieved by direct addition to the coating liquid, or they may be dissolved in a low boiling point organic solvent which has no effect on silver halide color photographic materials, such as an alcohol (for example, methyl alcohol), prior to addition to the coating liquid. Furthermore, they can be dispersed and impregnated into a polymer such as a latex; they can be dissolved in high boiling point organic solvents; and they can be emulsified and dispersed in an aqueous solution.

The total amount of the compound of this invention added to the sensitive material is normally from 0.001 to 0.8 g per square meter. The addition of a total amount of from 0.005 to 0.5 g per square meter is preferred, and the addition of a total amount of from 0.01 to 0.3 g per square meter is most preferred.

The silver halide contained in the photographic emulsion layer of a photographic material according to the invention is preferably a silver iodobromide, silver iodochloride or silver iodochlorobromide which contains not more than about 30 mol % of silver iodide. The use of silver iodobromides which contain from about 2 mol % to about 25 mol % of silver iodide is most preferred. An amount of the silver halide to be used in the present invention is 0.5 to 129/m$^2$ as Ag.

The silver halide grains in the photographic emulsion may have a regular crystalline form, such as a cubic, octahedral or tetradecahedral form; an irregular crystalline form, such as a spherical or tabular form. They may have crystal defects such as twinned crystal planes, or they may have a composite form consisting of these forms.

The silver halide grains may be small, i.e., not more than about 0.2 μm, or large, such that the projected area diameter is up to about 10 μm, and they may take the form of a polydisperse emulsion or a monodisperse emulsion.

The silver halide photographic emulsions which can be used in the invention can be prepared using the methods disclosed in *Research Disclosure*, (RD) No. 17643 (December, 1978), pages 22–23, "I. Emulsion Preparation and Types", and in RD No. 18716 (November, 1979), page 648; in *Chemie et Physique Photographique*, by P. Glafkides, (Paul Montel, 1967); in *Photographic Emulsion Chemistry*, by G. F. Duffin, (Focal Press, 1966); and in *Making and Coating Photographic Emulsions*, by V. L. Zelikman et al., (Focal Press, 1964).

The monodisperse emulsions disclosed in U.S. Pat. Nos. 3,574,628 and 3,655,394, and in British Patent 1,413,748 are preferred.

Furthermore, tabular grains which have an aspect ratio of at least about 5 can be used in the invention. Tabular grains can be prepared easily using the methods disclosed by Gutoff, *Photographic Science and Engineering*, Vol. 14, pages 248–257 (1970), in U.S. Pat. Nos. 4,434,226, 4,414,310, 4,433,048 and 4,439,520 and British Patent 2,112,157. The crystal structure may be uniform, the interior and exterior parts may have a heterogeneous halogen composition, or the grains may have a layered structure and, moreover, silver halides which have different compositions may be joined with an epitaxial junction or they may be joined with compounds other than silver halides, such as silver thiocyanate or lead oxide.

Mixtures of grains of various crystalline forms can also be used.

The silver halide emulsions used are normally subjected to physical ripening, chemical ripening and spectral sensitization. Additives which can be used in these processes have been disclosed in *Research Disclosure*, Nos. 17643 and 18716 as summarized in the table below.

Known photographically useful additives which can be used in the invention are also disclosed in the two *Research Disclosures* shown in the table below. Of these additives, an amount of binder to be used in the present invention is 1.0 to 25.0 g/m$^2$.

| Type of Additive | RD 17643 | RD 18716 |
|---|---|---|
| 1. Chemical sensitizers | Page 23 | Page 648, right column |
| 2. Speed increasing agents | | " |
| 3. Spectral sensitizers Strong color sensitizers | Pages 23–24 | Page 648, right column to page 649, right column |
| 4. Whiteners | Page 24 | |
| 5. Antifoggants and Stabilizers | Pages 24–25 | Page 649, right column |
| 6. Light absorbers, Filter dyes, UV Absorbers | Pages 25–26 | Page 649, right column to page 650, left column |
| 7. Antistaining agents | Page 25, right column | Page 650, left to right columns |
| 8. Dye image stabilizers | Page 25 | |
| 9. Film hardening agents | Page 26 | Page 651, left column |
| 10. Binders | Page 26 | " |
| 11. Plasticizers, Lubricants | Page 27 | Page 650, right column |
| 12. Coating promotors, Sufactants | Pager 26–27 | " |
| 13. Antistatic agents | Page 27 | " |

Various color couplers can be used in this invention and specific examples have been disclosed in the patents disclosed in *Research Disclosure*, No. 17643, VII-C-G.

The couplers disclosed in U.S. Pat. Nos. 3,933,501, 4,022,620, 4,326,024 and 4,401,752, in JP-B-58-10739 (the term "JP-B" as used herein refers to an "examined Japanese patent publication"), and in British Patents 1,425,020 and 1,476,760, etc., are preferred as yellow couplers.

The 5-pyrazolone and pyrazoloazole based compounds are preferred as magenta couplers, and those disclosed in U.S. Pat. Nos. 4,310,619 and 4,351,897, in European Patent 73,636B, in U.S. Pat. Nos. 3,061,432 and 3,725,067, in *Research Disclosure*, No. 24220 (June, 1984), in JP-A-60-33552, in *Research Disclosure*, No. 24230 (June, 1984), in JP-A-60-43659, and in U.S. Pat. Nos. 4,500,630 and 4,540,654, etc., are most preferred.

Phenol and naphthol based couplers are used as cyan couplers, and those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, in West German Patent (DT-OS) 3,329,729, in European Patent 121,365A, in U.S. Pat. Nos. 3,446,622, 4,333,999, 4,451,559 and 4,427,767, and in European Patent 161,626A are preferred.

The colored couplers for correcting the unwanted absorptions of colored dyes disclosed in *Research Disclosure*, No. 17643, section VII-G, in U.S. Pat. No. 4,163,670, in JP-B-57-39413, in U.S. Pat. Nos. 4,004,929 and 4,138,258, and in British Patent 1,146,368 are preferred.

The couplers providing colored dyes with a suitable degree of diffusibility disclosed in U.S. Pat. No. 4,366,237, in British Patent 2,125,570, in European Patent 96,570B, and in West German Patent (DT-OS) 3,234,533 are preferred.

Typical examples of polymerized dye forming couplers have been disclosed in U.S. Pat. Nos. 3,451,820, 4,080,211 and 4,367,282, and-in British Patent 2,102,173.

The couplers which release photographically useful residual groups on coupling can also be used preferentially in this invention. The DIR couplers which release development inhibitors disclosed in the patents disclosed in the aforementioned *Research Disclosure*, No. 17643, sections VII-F, in JP-A-57-151944, JP-A-57-154234 and JP-A-60-184248, and in U.S. Pat. No. 4,248,962 are preferred.

The couplers disclosed in British Patents 2,097,140 and 2,131,188, and in JP-A-59-157638 and JP-A-59-17084 are preferred as couplers which release nucleating agents or development accelerators during development.

Other couplers which can be used in the light-sensitive materials of this invention include the competitive couplers disclosed in U.S. Pat. No. 4,130,427, the multi-equivalent couplers disclosed in U.S. Pat. Nos. 4,283,472, 4,338,393 and 4,310,618, the DIR redox compound releasing couplers disclosed in JP-A-60-185950 and JP-A-62-24252, the couplers which release a dye to which color is restored after elimination as disclosed in European Patent 173,302A, the bleaching accelerator releasing couplers disclosed in *Research Disclosure*, Nos. 11449 and 24241, and in JP-A-61-201247, and the ligand releasing couplers disclosed in U.S. Pat. No. 4,553,477.

Specific examples of color couplers which can be used in the invention are indicated below, but the invention is not to be construed as being limited to these color couplers.

Amount of couplers to be used in the present invention are $2\times10^{-4}$ to $3\times10^{-3}$ mol/m$^2$ for yellow coupler; $5\times10^{-5}$ to $3\times10^{-3}$ mol/m$^2$ for magenta coupler and $1\times10^{-4}$ to $3\times10^{-3}$ mol/m$^2$ for cyan coupler.

C-(1)

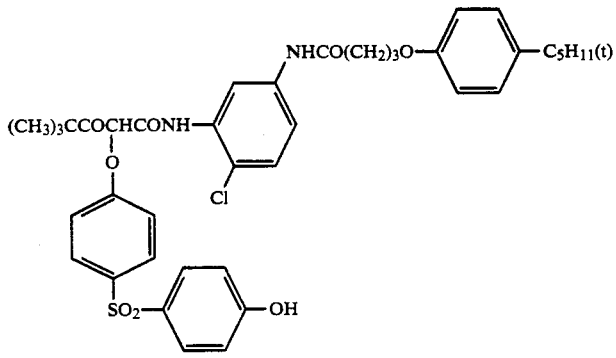

C-(2)

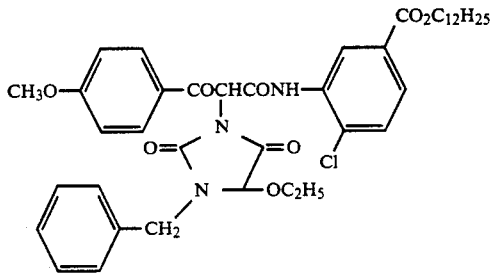

C-(3)

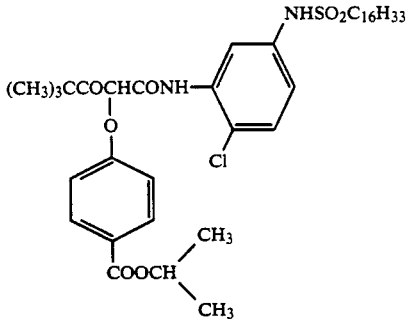

C-(4)

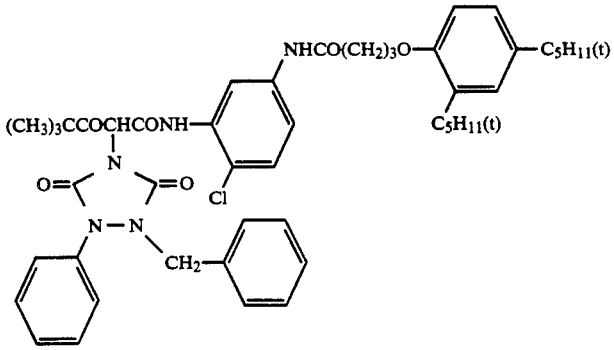

-continued
C-(5)
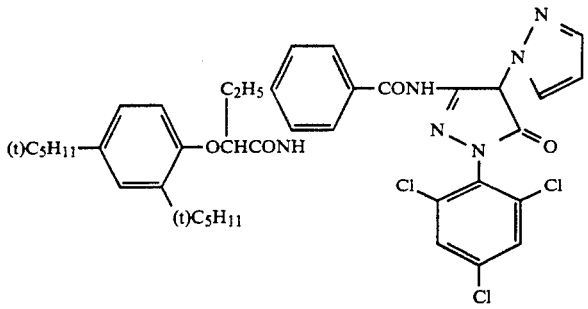
C-(6)
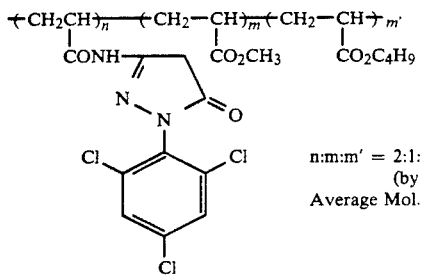
n:m:m' = 2:1:1
(by weight)
Average Mol. Wt. about 40,000
C-(7)
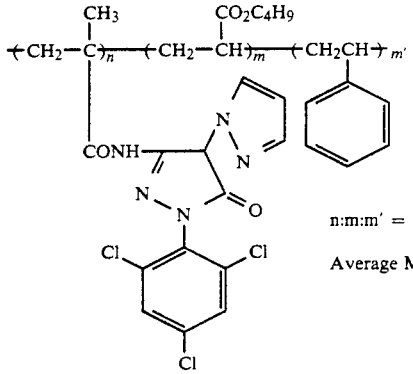
n:m:m' = 50:25:25
(wt. %)
Average Mol. Wt. about 30,000
C-(8)
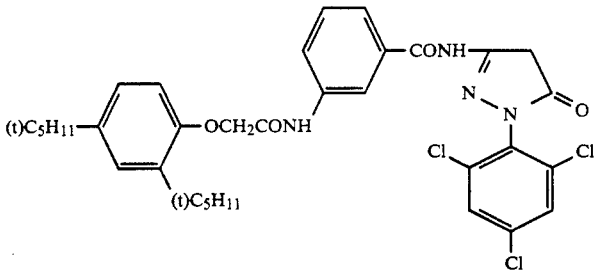
C-(9)
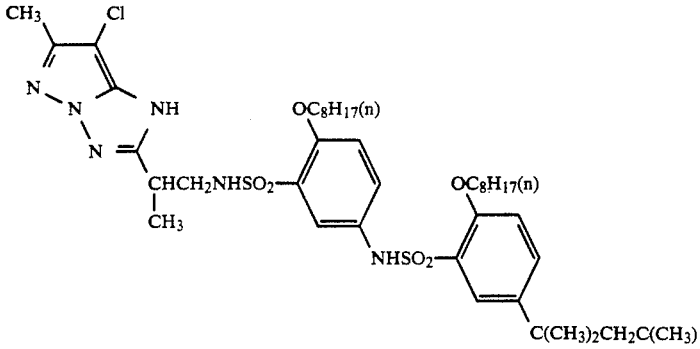

-continued
C-(10)
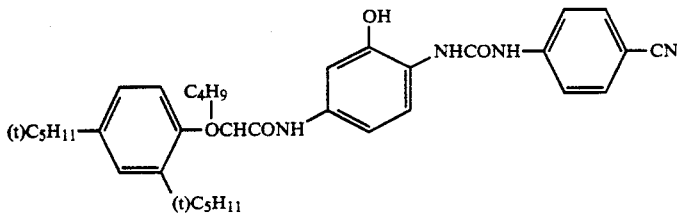
C-(11)
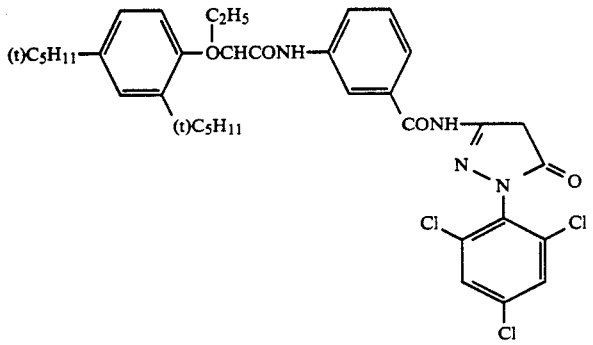
C-(12)
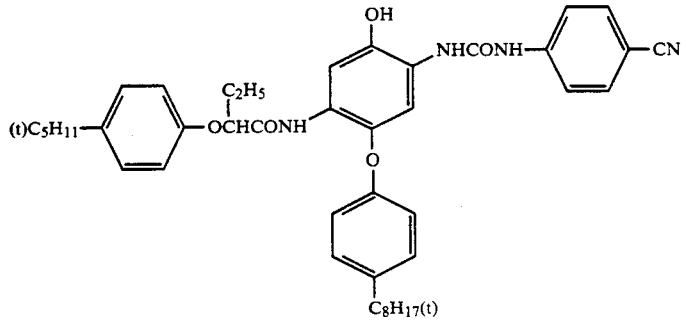
C-(13)
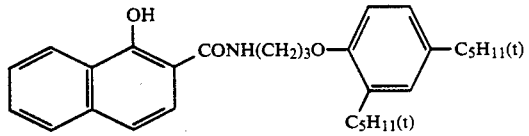
C-(14)
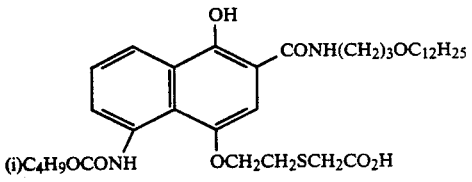
C-(15)
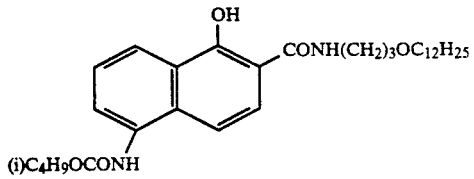

-continued
C-(16)
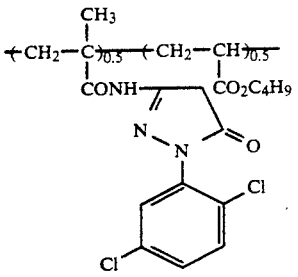
(Numbers signify ratio by weight)
Average Mol. Wt. about 40,000
C-(17)
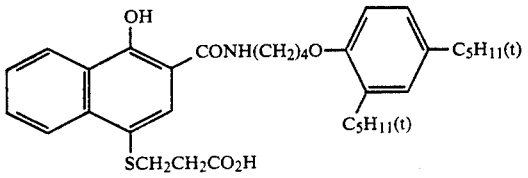
C-(18)
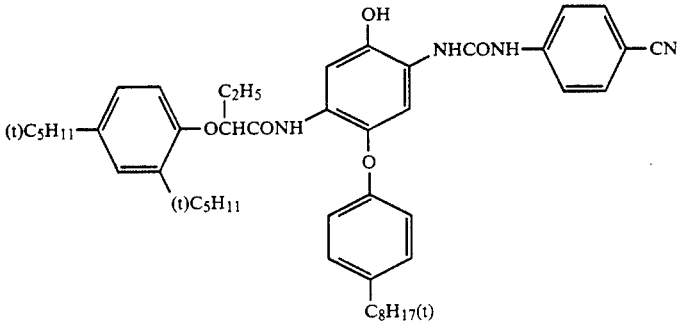
C-(19)
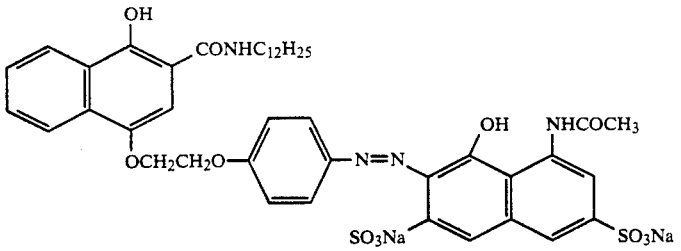
C-(20)
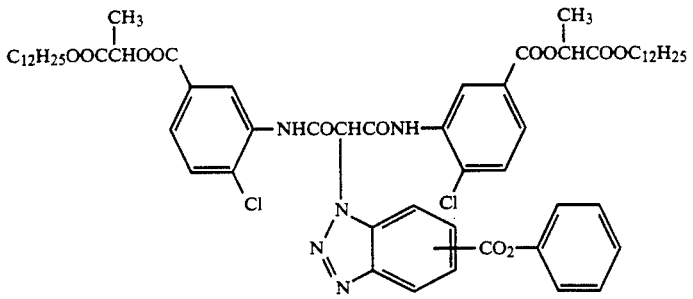

-continued
C-(21)
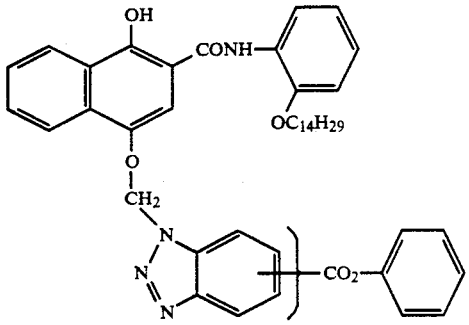
C-(22)
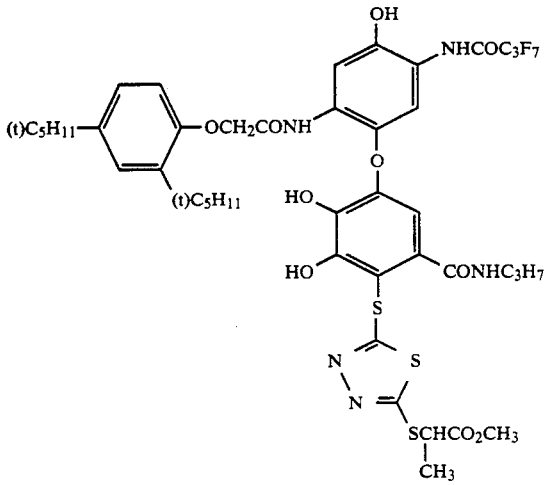
C-(23)
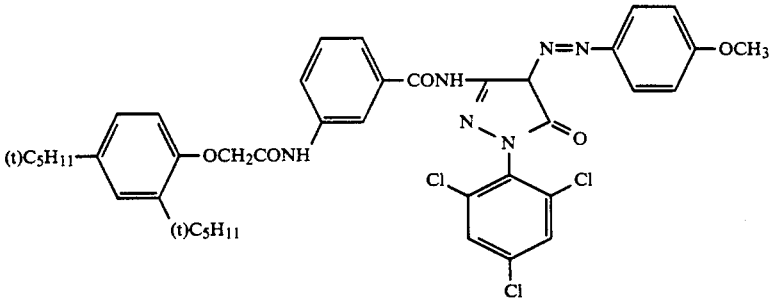
C-(24)
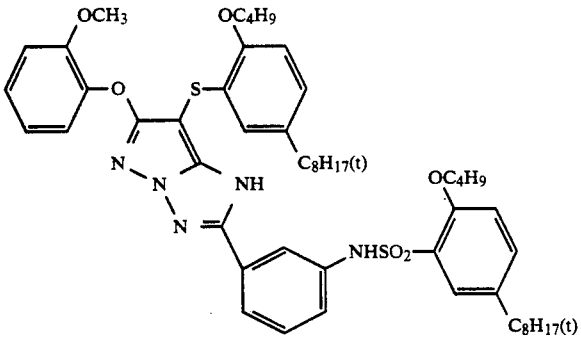

-continued
C-(25)
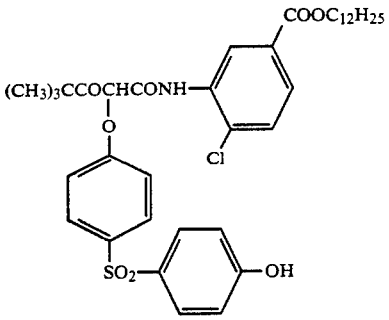
C-(26)
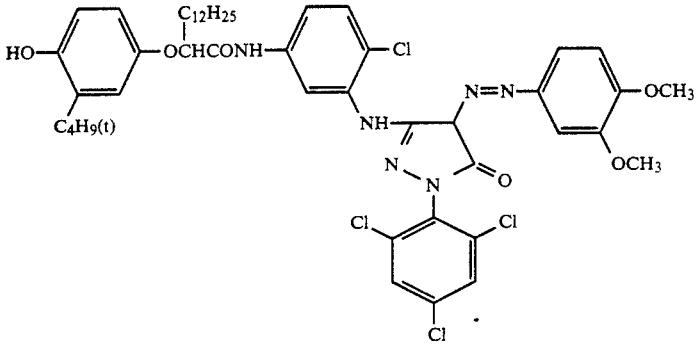
C-(27)
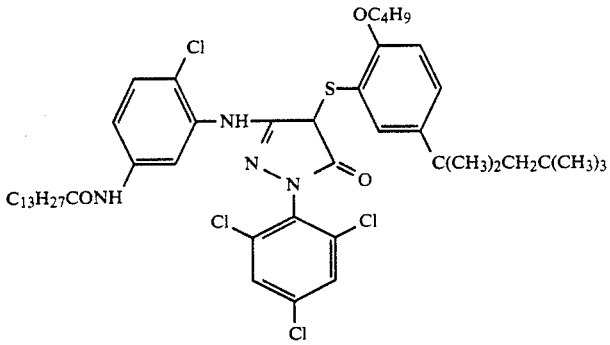
C-(28)
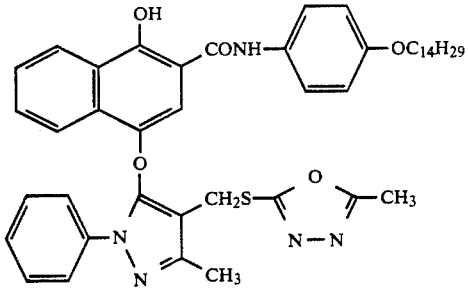
C-(29)
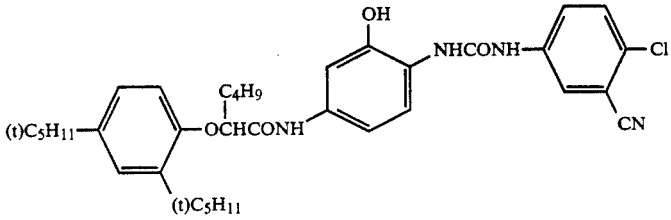

-continued
C-(30)
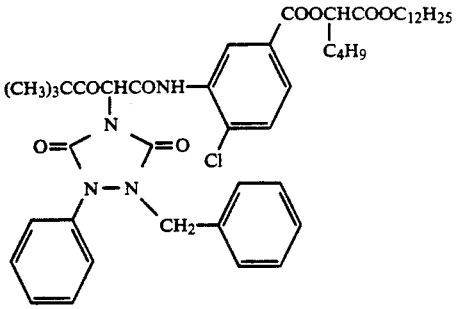
C-(31)
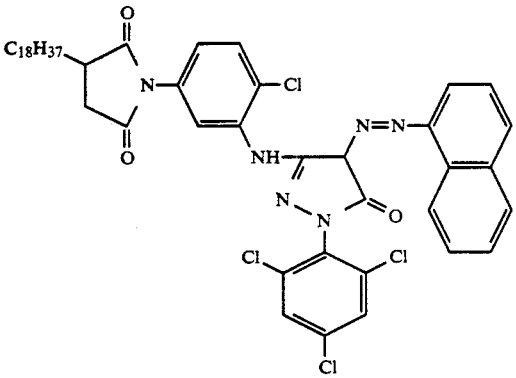
C-(32)
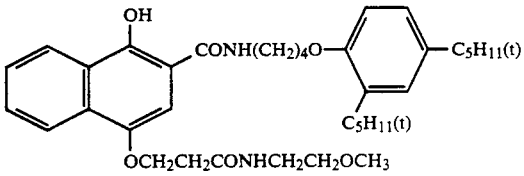
C-(33)
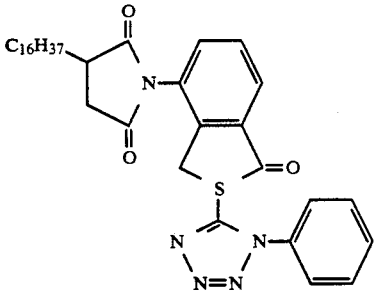
C-(34)
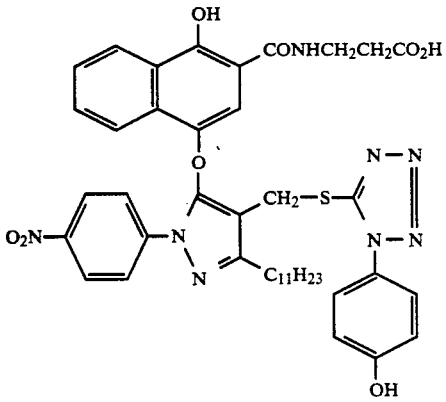

-continued
C-(35)
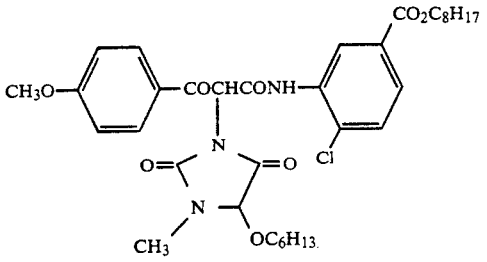
C-(36)
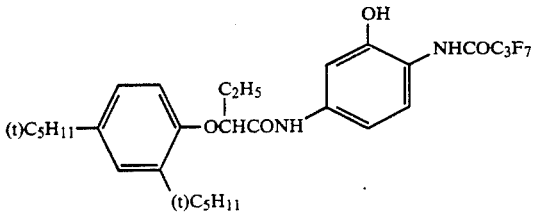
C-(37)
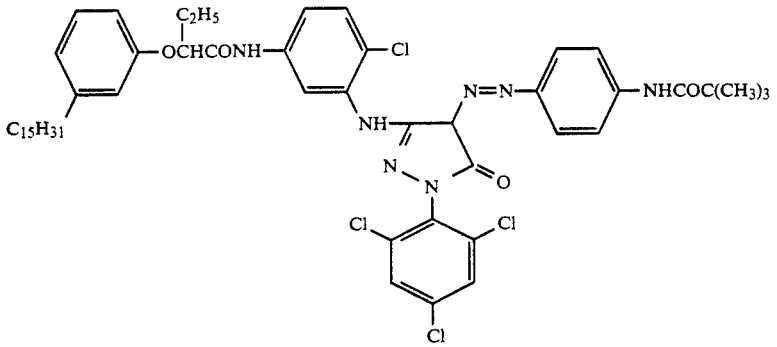
C-(38)
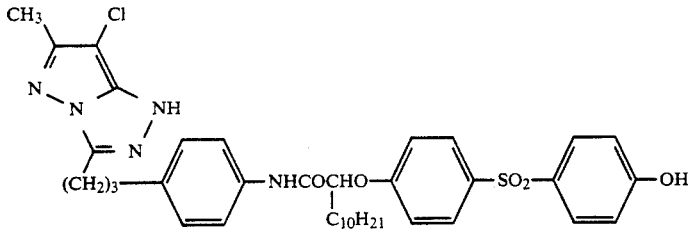
C-(39)
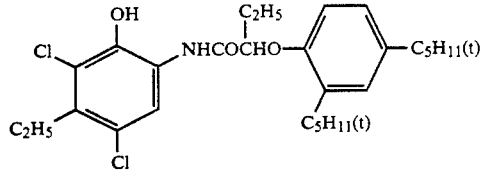
C-(40)
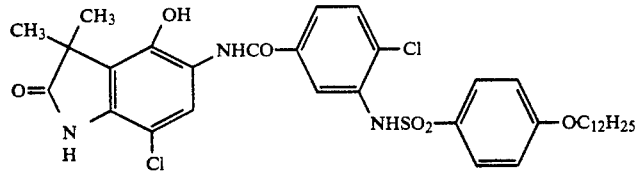
C-(41)
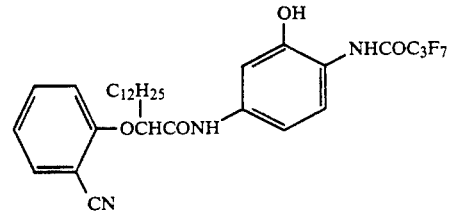

-continued
C-(42)
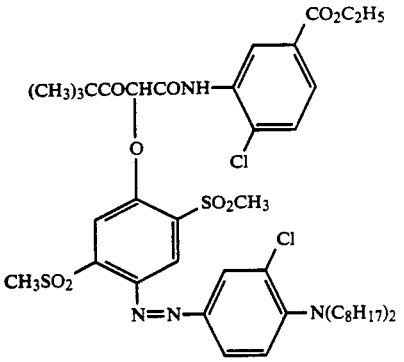
C-(43)
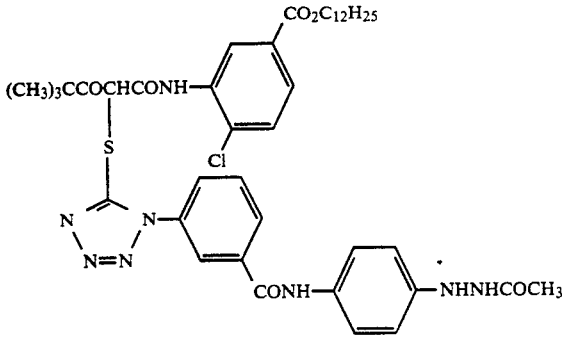
C-(44)
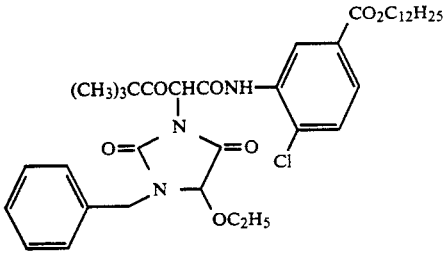
C-(45)
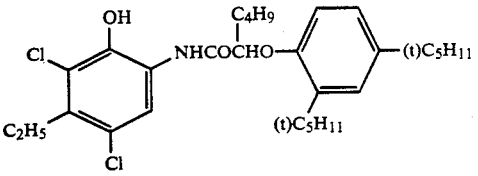
C-(46)
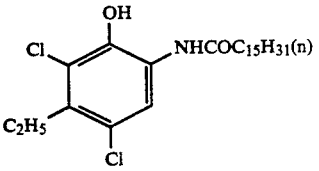
C-(47)
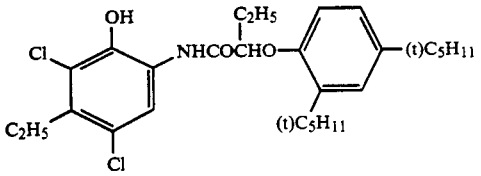

-continued
C-(48)
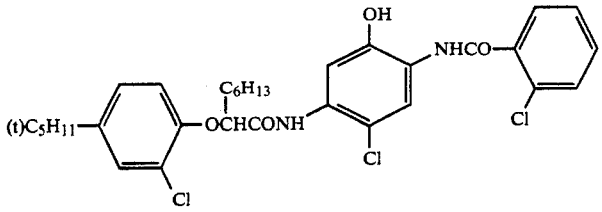
C-(49)
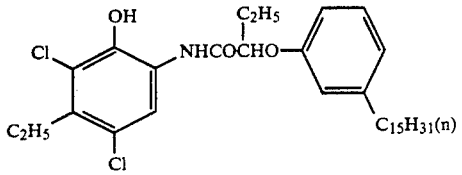
C-(50)
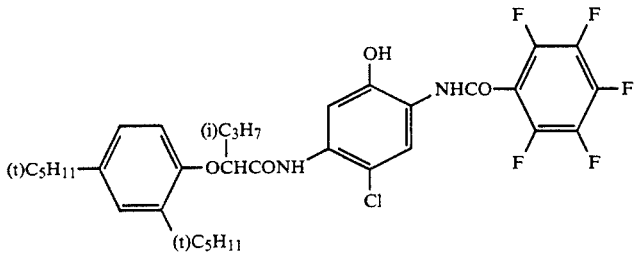
C-(51)
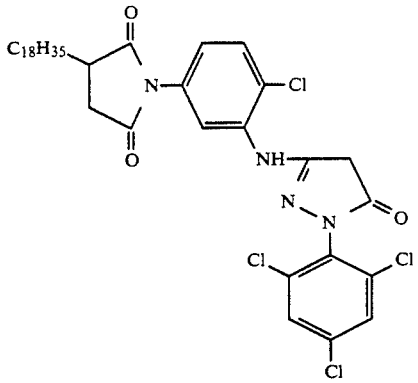
C-(52)
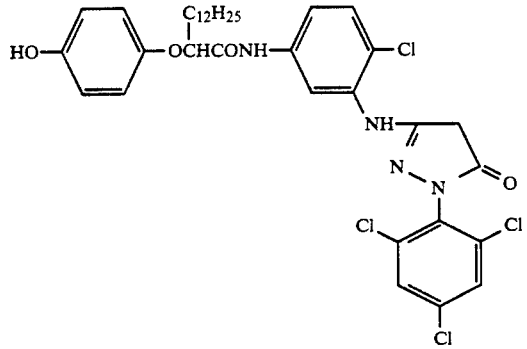

-continued
C-(53)
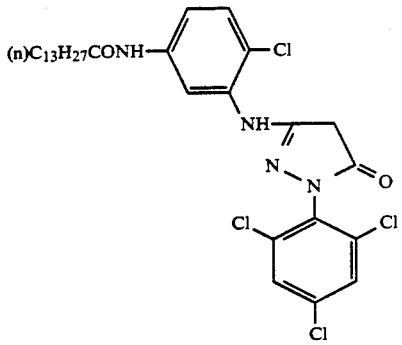
C-(54)
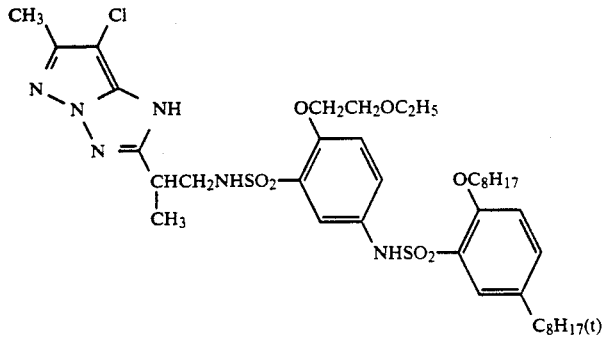
C-(55)
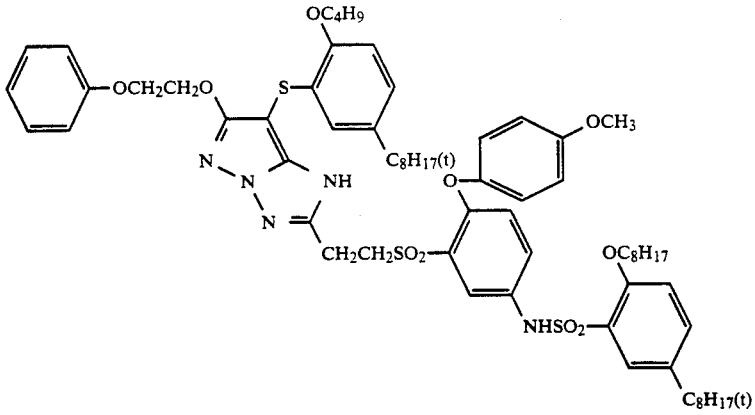
C-(56)
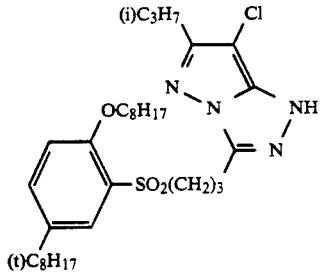

-continued

C-(57)

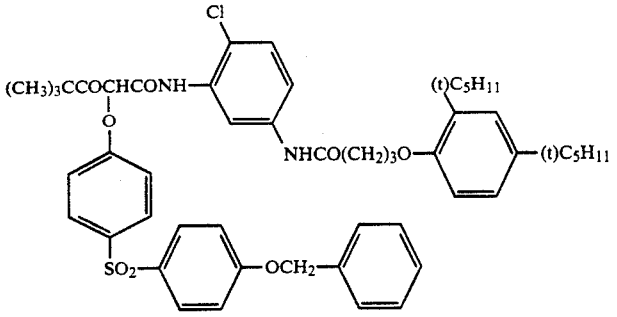

C-(58)

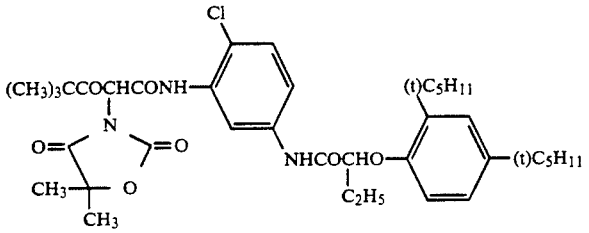

C-(59)

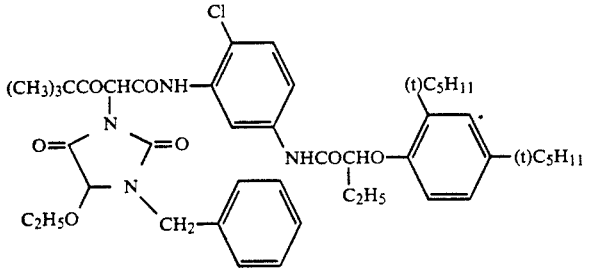

C-(60)

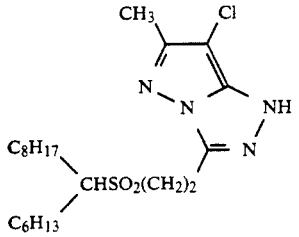

The couplers used in the invention can be introduced into the light-sensitive materials using various known methods of dispersion.

Examples of high boiling point solvents which can be used in the oil-in-water dispersion methods have been disclosed in U.S. Pat. No. 2,322,027.

Examples of high boiling point organic solvents of boiling point at normal pressure at least 175° C. which can be used in the oil-in-water dispersion method include phthalic acid esters (dibutyl phthalate, dicyclohexyl phthalate, di-2-ethylhexyl phthalate, decyl phthalate, bis(2,4-di-t-amylphenyl)phthalate, bis(2,4-di-t-amylphenyl)isophthalate, bis(1,1-diethylpropyl)phthalate), phosphoric and phosphonic acid esters (triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphonate), benzoic acid esters (2-ethylhexyl benzoate, dodecyl benzoate, 2-ethylhexyl p-hydroxybenzoate), amides (N,N-diethyldodecanamide, N,N-diethyllaurylamide, N-tetradecylpyrrolidone), alcohols or phenols (isostearyl alcohol, 2,4-di-tert-amylphenol), aliphatic carboxylic acid esters (bis(2-ethylhexyl) sebacate, dioctyl azelate, glycerol tributyrate, isostearyl lactate, trioctyl citrate), aniline derivatives (N,N-dibutyl-2-butoxy-5-tert-octylaniline), and hydrocarbons (paraffins, dodecylbenzene, diisopropylnaphthalene). Furthermore, organic solvents having a boiling point of at least about 30° C., and preferably a boiling point of at least 50° C., but less than about 160° C. can also be used as auxiliary solvents, and typical examples include ethyl acetate, butyl acetate, ethyl propionate, methyl ethyl ketone, cyclohexanone, 2-ethoxyethyl acetate, and dimethylformamide.

The processes and effects of the latex dispersion method and examples of latexes for impregnation purposes have been disclosed in U.S. Pat. No. 4,199,363, and in West German Patents (DT-OS) 2,541,274 and 2,541,230.

The invention can be applied to various color photosensitive materials. Typical examples include color negative films for general purposes or for cinematographic purposes, color reversal films for slides or television purposes, color papers, color positive films and color reversal papers.

Suitable supports which can be used in the invention have been disclosed, for example, on page 28 of the aforementioned *Research Disclosure*, No. 17643 and in *Research Disclosure*, No. 18716 from the right hand column on page 647 to the left hand column on page 648.

Color photographic materials according to the invention can be developed and processed using conventional methods disclosed on pages 28 and 29 of *Research Disclosure*, No. 17643 and from the left hand column to the right hand column of page 651 of *Research Disclosure*, No. 18716.

The color development bath used for the development processing of photosensitive materials of this invention is preferably an aqueous alkaline solution which contains a primary aromatic amine based color developing agent as the principal component. Aminophenol based compounds are also useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and the sulfate, hydrochloride and p-toluenesulfonate salts of these compounds. Two or more of these compounds can be used together, depending on the intended purpose.

The color development baths generally contain pH buffers, such as the carbonates, borates or phosphates of alkali metals, and development inhibitors or anti-fogging agents such as bromides, iodides, benzimidazoles, benzothiazoles or mercapto compounds. They may also contain, as required, various preservatives, such as hydroxylamine, diethylhydroxylamine, sulfites, hydrazines, phenylsemicarbazides, triethanolamine, catechol sulfonic acids, triethylenediamine(1,4-diazabicyclo[2,2,-2]octane), organic solvents such as ethylene glycol and diethylene glycol, development accelerators such as benzyl alcohol, poly(ethylene glycol), quaternary ammonium salts and amines, color forming couplers, competitive couplers, fogging agents such as sodium borohydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, typical examples of which include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediaminedi(o-hydroxyphenylacetic acid), and salts of these compounds.

Color development is carried out after normal black-and-white development in the case of reversal processing. Known black-and-white developing agents, for example, the dihydroxybenzenes such as hydroquinone, the 3-pyrazolidones such as 1-phenyl-3-pyrazolidone, and the aminophenols such as N-methyl-p-aminophenol, can be used individually or together in the black-and-white development bath.

The pH of these color development baths and black-and-white development baths is generally within the range from 9 to 12. Furthermore, the replenishment rate of the development bath depends on the color photographic material which is being processed, but it is generally not more than 3 liters per square meter of photosensitive material, and it is possible, by reducing the bromide ion concentration in the replenisher, to use a replenishment rate of not more than 500 ml per square meter of photosensitive material. The prevention of loss of liquid by evaporation, and aerial oxidation, by minimizing the contact area with the air in the processing tank, is desirable in cases where the replenishment rate is low. Furthermore, the replenishment rate can be reduced suppressing the accumulation of bromide ion in the development bath.

The photographic emulsion layers are subjected to a normal bleaching process after color development. The bleaching process may be carried out at the same time as the fixing process (in a bleach-fix process) or it may be carried out as a separate process. Moreover, a bleach-fix process can be carried out after a bleach process in order to speed up processing. Moreover, processing can be carried out in two connected bleach-fix baths; a fixing process can be carried out before carrying out a bleach-fix process, or a bleaching process can be carried out after a bleach-fix process; according to the intended purpose of the processing. Compounds of a polyvalent metal such as iron(III), cobalt(III), chromium(VI), copper(II), peracids, quinones, and nitro compounds can be used as bleaching agents. Typical bleaching agents include ferricyanides; dichromates; organic complex salts of iron(III) or cobalt(III), for example, complex salts with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, or citric acid, tartaric acid, malic acid; persulfates; bromates; permanganates and nitrobenzenes. Of these materials, the use of the aminopolycarboxylic acid iron(III) complex salts, principally ethylenediaminetetraacetic acid iron(III) complex salts, and persulfates, is preferred both for rapid processing and the prevention of environmental pollution. Moreover, the aminopolycarboxylic acid iron(III) complex salts are especially useful in both bleach baths and bleach-fix baths. The pH of a bleach or bleach-fix bath in which aminopolycarboxylic acid iron(III) complex salts are being used is normally from 5.5 to 8, but a lower pH can be used in order to speed up processing.

Bleach accelerators can be used, as required, in the bleach baths, bleach-fix baths, or bleach or bleach-fix prebaths. Examples of useful bleach accelerators have been disclosed in the following publications: the compounds which have a mercapto group or a disulfide group disclosed in U.S. Pat. No. 3,893,858, West German Patents (DT-AS) 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623 and JP-A-53-28426, and in *Research Disclosure*, No. 17129 (July, 1978); the thiazolidine derivatives disclosed in JP-A-50-140129; the thiourea derivatives disclosed in JP-B-45-8506, JP-A-52-20832 and JP-A-53-32735, and in U.S. Pat. No. 3,706,561; the iodides disclosed in West German Patent (DT-AS) 1,127,715 and in JP-A-58-16235; the polyoxyethylene compounds disclosed in West German Patents (DT-AS) 966,410 and 2,748,430; the polyamine compounds disclosed in JP-B-45-8836; the compounds disclosed in JP-A-49-42434, JP-A-49-59644, JP-A-53-94927, JP-A-54-35727, JP-A-55-26506 and JP-A-58-163940; and bromide ions. Among these compounds, those which have a mercapto group or a disulfide group are preferred in view of their large accelerating effect, and the use of the compounds disclosed in U.S. Pat. No. 3,893,858, West German Patent (DT-AS) 1,290,812, and in JP-A-53-95630 is especially preferred. Moreover, the use of the compounds disclosed in U.S. Pat. No. 4,552,834 is also preferred. These bleach accelerators may be added to the sensitive material. These bleach accelerators are especially effective when bleach-fixing color photosensitive materials for photographic purposes.

Thiosulfates, thiocyanates, thioether based compounds, thioureas and large quantities of iodide, can be used as fixing agents, but thiosulfates are generally used for this purpose, and ammonium thiosulfate in particular can be used in the widest range of application. Sulfites, bisulfites, or carbonyl-bisulfite addition compounds, are preferred as preservatives for bleach-fix baths.

The silver halide color photographic materials of this invention are generally subjected to a water washing and/or stabilizing process after the desilvering process. The amount of water used in the water washing process can be fixed within a wide range according to the nature of the photosensitive material (for example, the materials, such as the couplers, which are being used), the wash water temperature, the number of washing tanks (the number of washing stages), the replenishment system, i.e., whether a counter-flow or a cocurrent system is used, and various other conditions. The relationship between the amount of water used and the number of water washing tanks in a multistage counter-flow system can be obtained using the method outlined on pages 248–253 of *Journal of the Society of Motion Picture and Television Engineers*, Vol. 64 (May, 1955).

The amount of wash water can be greatly reduced by using the multistage counter-flow system described there, but bacteria proliferate due to the increased residence time of the water in the tanks and problems arise as a result of the sediments which are formed becoming attached to the photosensitive material. The method in which the calcium ion and manganese ion concentrations are reduced as disclosed in JP-A-62-288838 can be used very effectively to overcome problems of this sort in the processing of color photosensitive materials of this invention. Furthermore, the isothiazolone compounds and thiabendazoles disclosed in JP-A-57-8542, chlorine based disinfectants such as sodium chloroisocyanurate, and benzotriazoles, and the disinfectants disclosed in *Chemistry of Biocides and Fungicides* by Horiguchi, *Reduction of Microorganisms, Biocidal and Fungicidal Techniques*, published by the Health and Hygiene Technical Society and in *A Dictionary of Biocides and Fungicides*, published by the Japanese Biocide and Fungicide Society, can be used for this purpose.

The pH value of the wash water used in the processing of the photosensitive materials of the invention is within the range from 4 to 9, and preferably within the range from 5 to 8. The wash water temperature and the washing time can bevaried according to the nature of the photosensitive material and the application, but, in general, washing conditions of from 20 seconds to 10 minutes at a temperature of from 15° to 45° C., and preferably of from 30 seconds to 5 minutes at a temperature of from 25° to 40° C., are selected. Moreover, the photosensitive materials of this invention can be processed directly in a stabilizing bath instead of being subjected to a water wash as described above. The known methods disclosed in JP-A-57-8543, JP-A-58-14834 and JP-A-60-220345 can all be used for this purpose.

Furthermore, a stabilization process can be carried out following the aforementioned water washing process, and the stabilizing baths which contain formalin and surfactant which are used as a final bath for color photosensitive materials used for photographic purposes can be used. Various chelating agents and fungicides can be added to these stabilizing baths.

The overflow which accompanies replenishment of the above-mentioned wash water and/or stabilizer can be reused in other processes such as the desilvering process.

A color developing agent may also be incorporated into the silver halide color photosensitive materials of this invention in order to simplify and speed-up processing. The incorporation of various color developing agent precursors is preferred. For example, the indoaniline based compounds disclosed in U.S. Pat. No. 3,342,597, the Schiff's base type compounds disclosed in U.S. Pat. No. 3,342,599 and in *Research Disclosure*, Nos. 14850 and 15159, the aldol compounds disclosed in *Research Disclosure*, No. 13924, the metal salt complexes disclosed in U.S. Pat. No. 3,719,492, and the urethane based compounds disclosed in JP-A-53-135628 can be used for this purpose.

Various 1-phenyl-3-pyrazolidones can be incorporated, as required, into the silver halide color photosensitive materials of this invention with a view to accelerating color development. Typical compounds of this type have been disclosed in JP-A-56-64339, JP-A-57-144547 and JP-A-58-115438.

The various processing baths are used at a temperature of from 10° to 50° C. in this invention. The standard temperature is normally from 33° to 38° C., but processing is accelerated and the processing time is shortened at higher temperatures and, conversely, increased picture quality and improved stability of the processing baths can be achieved at lower temperatures. Furthermore, processes using hydrogen peroxide intensification or cobalt intensification as disclosed in West German Patent (DT-AS) 2,226,770 or U.S. Pat. No. 3,674,499 can be carried out in order to economize on silver in the photosensitive material.

Furthermore, silver halide photosensitive materials of this invention can also be used as the heat developable photosensitive materials disclosed in U.S. Pat. No. 4,500,626, JP-A-60-133449, JP-A-59-218443 and JP-A-61-238056, and in European Patent 210,660A2.

EXAMPLES

The invention is described in detail below with reference to specific examples, but the invention is not to be construed as being limited by these examples. Unless otherwise indicated, all parts, percents and ratios are by weight.

EXAMPLE 1

Each of the layers having the compositions indicated below was lamination coated onto an undercoated cellulose triacetate film to prepare the multilayer color photosensitive material sample 101.

Compositions of the Photosensitive Layers

The amount of each component indicates the coated weight in units of grams per square meter, and in the case of silver halides the amount is indicated as the coated weight calculated as silver. However, in the case of the sensitizing dyes the amount coated is indicated in units of mols per mol of silver in the same layer.

| Sample 101 | |
|---|---|
| First Layer: Antihalation Layer | |
| Black colloidal silver | as silver 0.18 |
| Gelatin | 0.40 |
| Second Layer: Intermediate Layer | |
| 2,5-Di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third Layer: First Red-Sensitive Emulsion Layer | |
| Emulsion A | as silver 0.25 |
| Emulsion B | as silver 0.25 |
| Sensitizing Dye IX | $6.9 \times 10^{-5}$ |
| Sensitizing Dye II | $1.8 \times 10^{-5}$ |
| Sensitizing Dye III | $3.1 \times 10^{-4}$ |
| EX-2 | 0.335 |
| EX-3 | 0.025 |
| EX-10 | 0.020 |
| Gelatin | 0.87 |
| Fourth Layer: Second Red-Sensitive Emulsion Layer | |
| Emulsion C | as silver 1.0 |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| EX-2 | 0.400 |
| EX-3 | 0.025 |
| EX-10 | 0.015 |
| Gelatin | 1.30 |
| Fifth Layer: Third Red-Sensitive Emulsion Layer | |
| Emulsion D | as silver 1.60 |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| EX-3 | 0.007 |
| EX-4 | 0.080 |
| EX-2 | 0.095 |
| HBS-1 | 0.22 |
| HBS-2 | 0.10 |
| Gelatin | 1.63 |
| Sixth Layer: Intermediate Layer | |
| EX-5 | 0.060 |
| HBS-1 | 0.040 |
| Gelatin | 0.70 |
| Seventh Layer: First Green-Sensitive Emulsion Layer | |
| Emulsion A | as silver 0.15 |
| Emulsion B | as silver 0.15 |
| Sensitizing Dye V | $3.0 \times 10^{-5}$ |
| Sensitizing Dye VI | $1.0 \times 10^{-4}$ |
| Sensitizing Dye VII | $3.8 \times 10^{-4}$ |
| EX-6 | 0.260 |
| EX-1 | 0.012 |
| EX-7 | 0.015 |
| EX-8 | 0.025 |
| HBS-1 | 0.100 |
| HBS-3 | 0.010 |
| Gelatin | 0.63 |
| Eighth Layer: Second Green-Sensitive Emulsion Layer | |
| Emulsion C | as silver 0.45 |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.094 |
| EX-8 | 0.018 |
| EX-7 | 0.026 |
| HBS-1 | 0.160 |
| HBS-4 | 0.008 |
| Gelatin | 0.50 |
| Ninth Layer: Third Green-Sensitive Emulsion Layer | |
| Emulsion E | as silver 1.2 |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Tenth Layer: Yellow Filter Layer | |
| Yellow colloidal silver | as silver 0.05 |
| EX-5 | 0.08 |
| HBS-1 | 0.03 |
| Gelatin | 0.95 |
| Eleventh Layer: First Blue-Sensitive Emulsion Layer | |
| Emulsion A | as silver 0.08 |
| Emulsion B | as silver 0.07 |
| Emulsion F | as silver 0.07 |
| Sensitizing Dye VIII | $3.5 \times 10^{-4}$ |
| EX-9 | 0.721 |
| EX-8 | 0.042 |
| HBS-1 | 0.28 |
| Gelatin | 1.10 |
| Twelfth Layer: Second Blue-Sensitive Emulsion Layer | |
| Emulsion G | as silver 0.45 |
| Sensitizing Dye VIII | $2.1 \times 10^{-4}$ |
| EX-9 | 0.154 |
| EX-10 | 0.007 |
| HBS-1 | 0.05 |
| Gelatin | 0.78 |
| Thirteenth Layer: Third Blue-Sensitive Emulsion Layer | |
| Emulsion H | as silver 0.77 |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Emulsion I | as silver 0.5 |
| U-4 | 0.11 |
| U-5 | 0.17 |
| HBS-1 | 0.05 |
| Gelatin | 1.00 |
| Fifteenth Layer: Second Intermediate Layer | |
| Poly(methyl acrylate) particles (average particle size 1.5 μm) | 0.54 |
| S-1 | 0.20 |
| S-2 | 0.05 |
| Gelatin | 1.20 |

Gelatin hardening agent H-1 and surfactant were added as well as the components indicated above to each layer.

Samples 102 to 108

Samples 102 to 108 were prepared by replacing the compound EX-5 in the sixth layer of sample 101 with equimolar amounts of the compounds shown in Table 1.

These samples were subjected to an imagewise exposure with red light and color developed in the way indicated below. The processed strips were subjected to density measurements and the values obtained by subtracting the magenta and yellow fog densities from the magenta and yellow densities at the point which gave a cyan density of fog+2.0 are shown in Table 1 as the color turbidity.

Furthermore, samples were developed under the conditions indicated below either immediately after exposure with white light (condition A), or after exposure to white light and storage in the dark for a period of 14 days under conditions of 40° C., relative humidity 80% (condition B). The change in speed (relative speed of fog+0.25 of the cyan density) of the red-sensitive layer under condition B with respect to condition A is shown in Table 1 as the change in speed under forced deterioration conditions. Here, the relative speed is the relative value of the reciprocal of the exposure required to provide a density of fog+0.25.

Moreover, the MTF value of the magenta image was calculated by exposing to an MTF value measuring pattern with green light after subjecting the samples to a uniform exposure to red light.

The color development processing was carried out using the processing operations indicated below at a temperature of 38° C.

| | |
|---|---|
| Color Development | 3 min 15 sec |
| Bleach | 6 min 30 sec |
| Water Wash | 2 min 10 sec |
| Fix | 4 min 20 sec |
| Water Wash | 3 min 15 sec |
| Stabilization | 1 min 05 sec |

The composition of the processing bath used in each operation was as indicated below.

| | |
|---|---|
| Color Development Bath | |
| Diethylenetriaminepentaacetic acid | 1.0 g |
| 1-Hyroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.0 |
| Bleach Bath | |
| Ethylenediaminetetraacetic acid ferric ammonium salt | 100.0 g |
| Ethylenediaminetetraacetic acid disodium salt | 10.0 g |
| Ammonium bromide | 150.0 g |
| Ammonium nitrate | 10.0 g |
| Water to make | 1.0 liter |
| pH | 6.0 |
| Fixing Bath | |
| Ethylenediaminetetraacetic acid disodium salt | 1.0 g |
| Sodium sulfite | 4.0 g |
| Aqueous ammonium thiosulfate solution (70%) | 175.0 ml |
| Sodium bisulfite | 4.6 g |
| Water to make | 1.0 liter |
| pH | 6.6 |
| Stabilizing Bath | |
| Formalin (40%) | 2.0 ml |
| Polyoxyethylene p-monononylphenyl ether (average degree of polymerization 10) | 0.3 g |
| Water to make | 1.0 liter |

TABLE 1

| Sample No. | Compound in the Sixth Layer | Color Turbidity Magenta | Color Turbidity Yellow | Change in Speed under Forced Deterioration Conditions | MTF Value (40 cycles/mm) |
|---|---|---|---|---|---|
| 101 (Comparison) | EX-5 | +0.08 | +0.16 | +0.12 | 0.46 |
| 102 (Comparison) | EX-14 | +0.09 | +0.18 | +0.11 | 0.45 |
| 103 (Comparison) | EX-15 | +0.11 | +0.20 | +0.08 | 0.44 |
| 104 (Comparison) | EX-16 | +0.13 | +0.22 | +0.02 | 0.42 |
| 105 (Invention) | 1 | +0.05 | +0.14 | +0.02 | 0.47 |
| 106 (Invention) | 2 | +0.04 | +0.13 | +0.01 | 0.48 |
| 107 (Invention) | 4 | +0.04 | +0.13 | +0.01 | 0.48 |
| 108 (Invention) | 7 | +0.04 | +0.13 | 0 | 0.48 |

It is clear from Table 1 that there was considerable color turbidity with samples (101, 102) which contained the conventional hydroquinone derivatives EX-5 and EX-14, and that these samples displayed a large change in speed under the forced deterioration conditions. It is also clear that samples (103, 104) which contained EX-15 and EX-16 displayed considerable color turbidity and that there was a deterioration in sharpness as indicated by the MTF value. On the other hand, it is clear that the samples of this invention had excellent color reproduction properties and sharpness, and that the change in speed under forced conditions was small, and the effectiveness of the invention was quite clear.

EXAMPLE 2

Sample 201 was prepared by establishing the intermediate layer indicated below between the eighth and ninth layers of Sample 101.

| Eighth Layer: Intermediate Layer | |
|---|---|
| EX-17 | 0.03 |
| HBS-2 | 0.03 |
| Gelatin | 0.50 |

Samples 202 to 204

Samples 202 to 204 were prepared by replacing the EX-17 in the eighth layer of sample 201 with equimolar amounts of the compounds shown in Table 2.

These samples were given a white, imagewise exposure and developed and processed as indicated below. Furthermore, samples were exposed through a wedge for measuring RMS granularity and, after development and processing in the same way as before, the RMS values of the magenta images were measured using an aperture of diameter 48 μm.

Color Development Processing

| Process | Processing Time | Processing Temperature (°C.) |
|---|---|---|
| Color Development | 2 min 30 sec | 40 |
| Bleach-Fix | 3 min 00 sec | 40 |
| Water Wash (1) | 20 sec | 35 |
| Water Wash (2) | 20 sec | 35 |
| Stabilization | 20 sec | 35 |
| Drying | 50 sec | 65 |

The compositions of the processing baths were as follows:

| | |
|---|---|
| Color Development Bath: | |
| Diethylenetriaminepentaacetic acid | 2.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-(N-Ethyl-N-β-hydroxyethylamino)-2-methylaniline sulfate | 4.5 g |
| Water to make | 1.0 liter |
| pH | 10.05 |
| Bleach-Fix Bath: | |
| Ethylenediaminetetraacetic acid ferric ammonium salt | 90.0 g |
| Ethylenediaminetetraacetic acid disodium salt | 5.0 g |
| Sodium sulfite | 12.0 g |
| Aqueous ammonium thiosulfate solution (70%) | 260.0 ml |
| Acetic acid (98%) | 5.0 ml |
| Bleach accelerator | 0.01 mol |

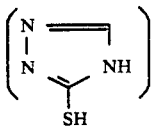

| | |
|---|---|
| Water to make | 1.0 liter |
| pH | 6.0 |

Water Wash Bath:

Town water was passed through a mixed bed column which had been packed with an H-type strongly acidic cation exchange resin ("Amberlite IR-120B", made by the Rohm & Haas Co.) and an OH-type anion exchange resin ("Amberlite IR-400", made by the same company) and treated in such a way that the calcium and magnesium ion concentrations were not more than 3 mg/liter, after which 20 mg/liter of sodium dichloroisocyanurate and 1.5 g/liter of sodium sulfate were added. The pH of this solution was within the range from 6.5 to 7.5.

| | |
|---|---|
| Stabilizing Bath: | |
| Formalin (37%) | 2.0 ml |
| Polyoxyethylene p-monononylphenyl ether (average degree of polymerization 10) | 0.3 g |
| Ethylenediaminetetraacetic acid disodium salt | 0.05 g |
| Water to make | 1.0 liter |
| pH | 5.0–8.0 |

TABLE 2

| Sample No. | Compound in the Eighth Layer | Relative Speed* | MRS Value × 1,000 (at magenta density 1.0) |
|---|---|---|---|
| 201 (Comparison) | EX-17 | 0 | 18.1 |
| 202 (Comparison) | EX-18 | −0.01 | 18.0 |
| 203 (Invention) | 4 | 0 | 17.4 |
| 204 (Invention) | 26 | −0.01 | 17.3 |

*Reciprocal of exposure required to provide a density of fog + 0.5 relative to that of sample 201 which was taken to be 0.

It is clear from Table 2 that the samples of this invention had better graininess at the same speed when compared to samples outside the scope of this invention.

Structural formulae of the compounds used in Examples 1 and 2.

EX-1

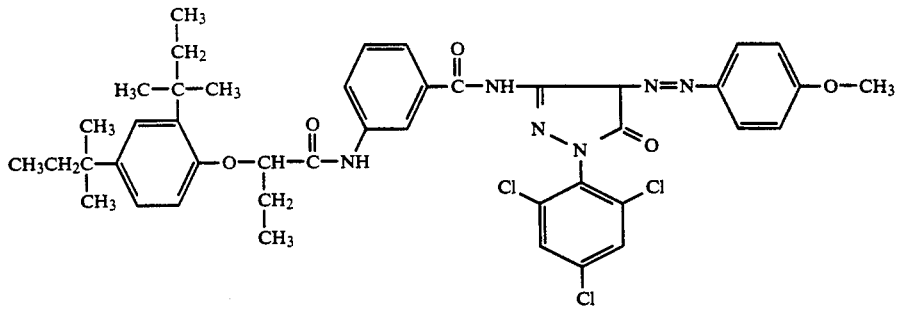

EX-2

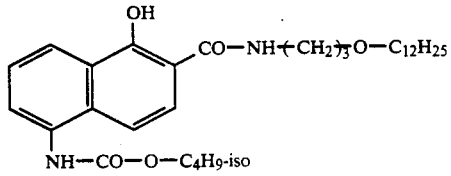

-continued
EX-3
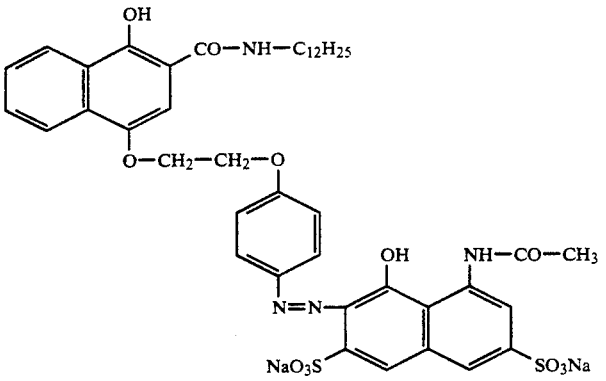
EX-4
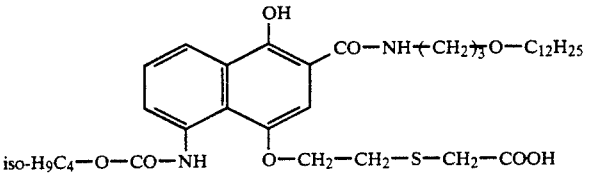
(Compound (6) in U.S. Pat. No. 2,336,327)
EX-5
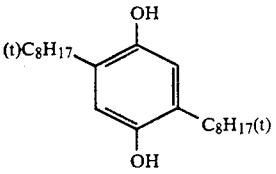
EX-6
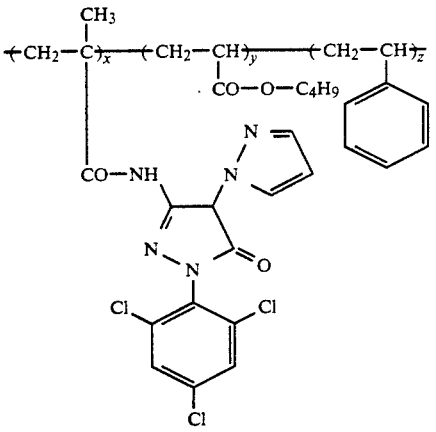
x:y:z = 50:25:25
Average Molecular Weight 30,000
EX-7
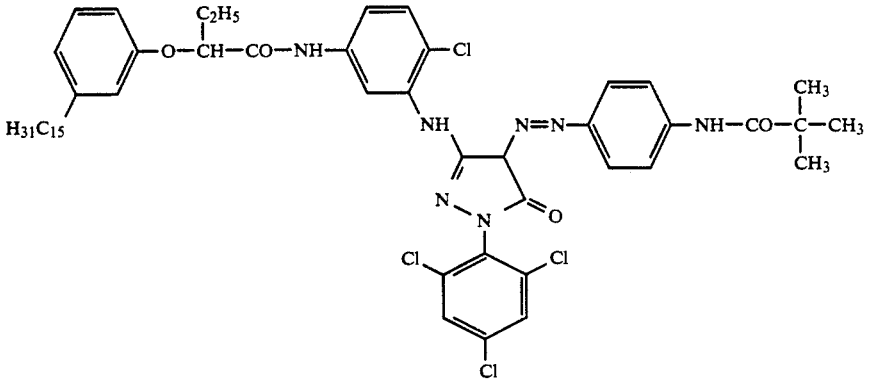

-continued
EX-8
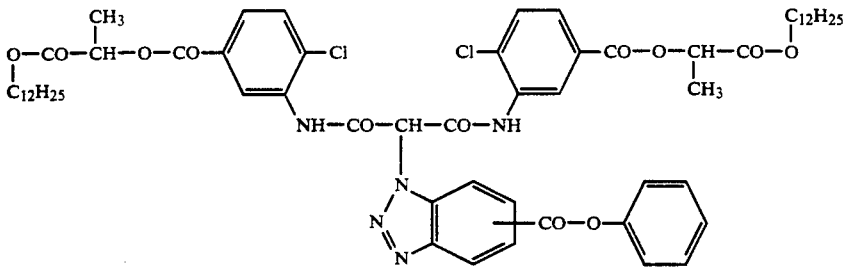
EX-9
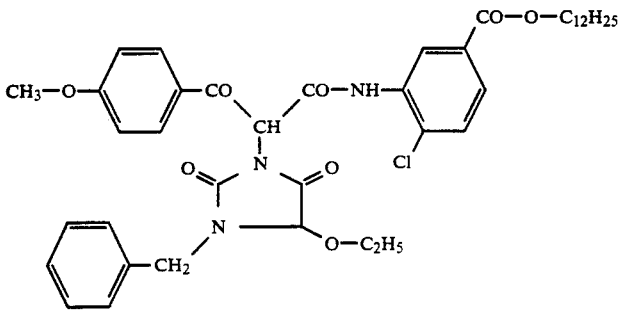
EX-10
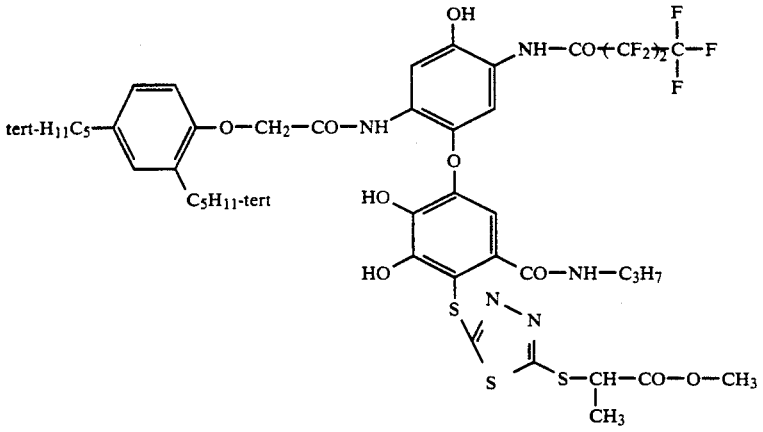
EX-11
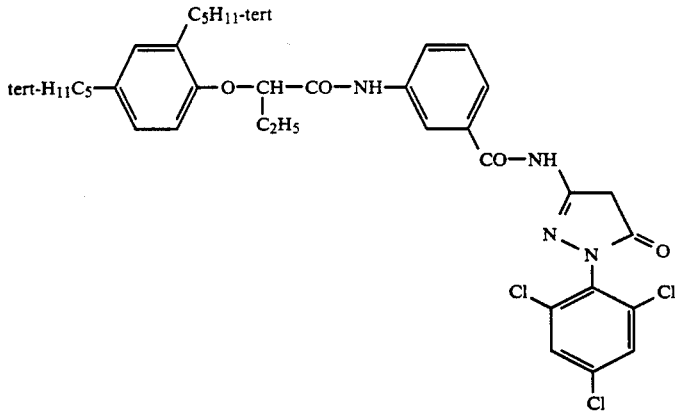
EX-12
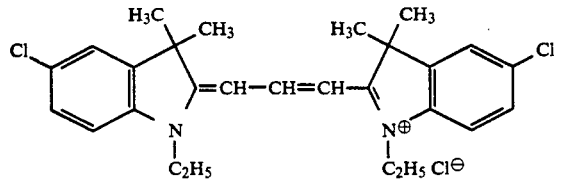

-continued
EX-13
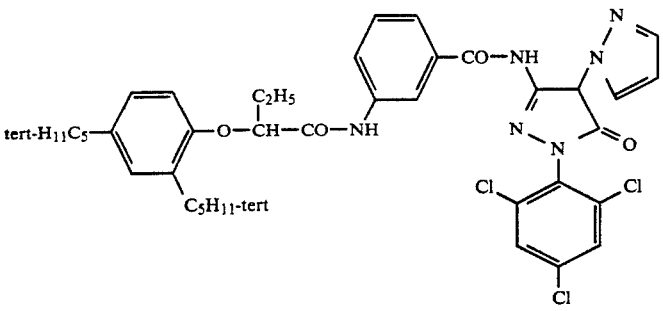
(Compound (1) of U.S. Pat. No. 4,277,553)
EX-14
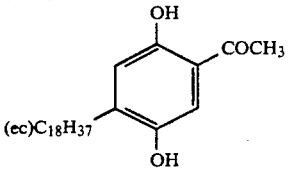
(Compound (5) of JP-A-62-27731)
EX-15
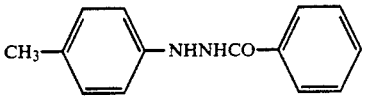
(Compound (1) of U.S. Pat. No. 4,390,618)
EX-16
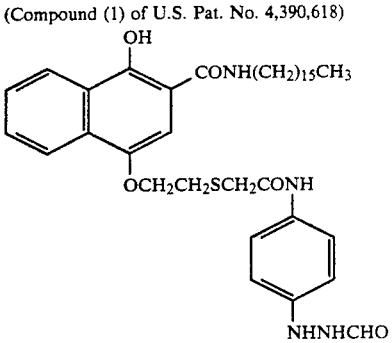
(Compound of U.S. Pat. No. 2,732,300)
EX-17
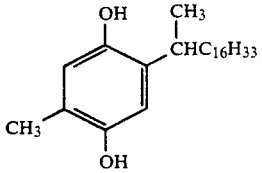
(Compound of U.S. Pat. No. 3,700,453)
EX-18
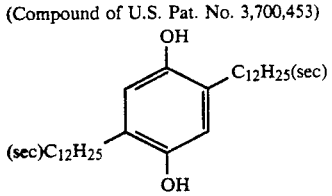
U-1
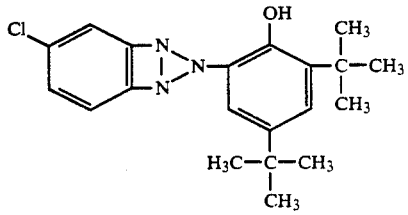

-continued
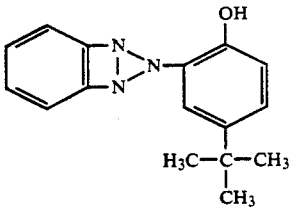
U-2
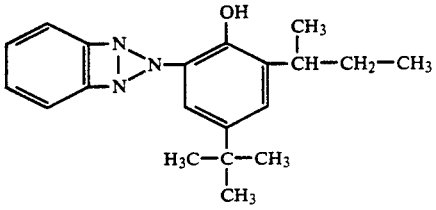
U-3
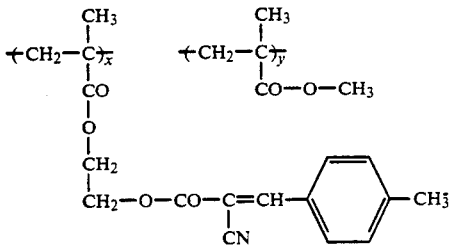
U-4
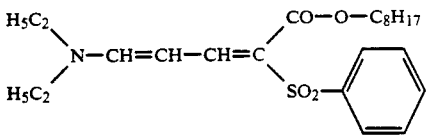
U-5
Tricresyl phosphate HBS-1
Dibutyl phthalate HBS-3
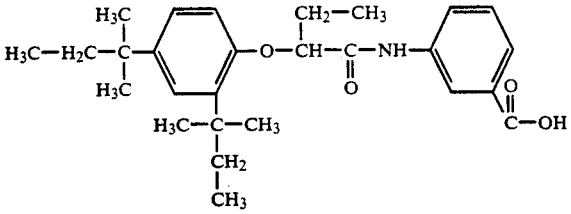
HBS-3
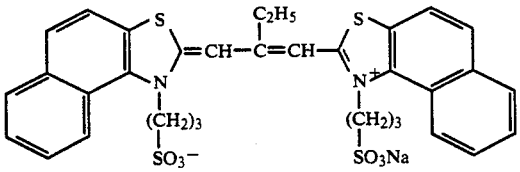
Sensitizing Dye II
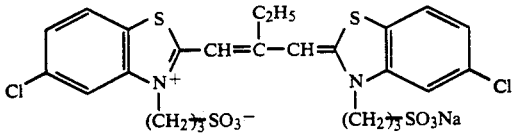
Sensitizing Dye III -continued Sensitizing Dye V

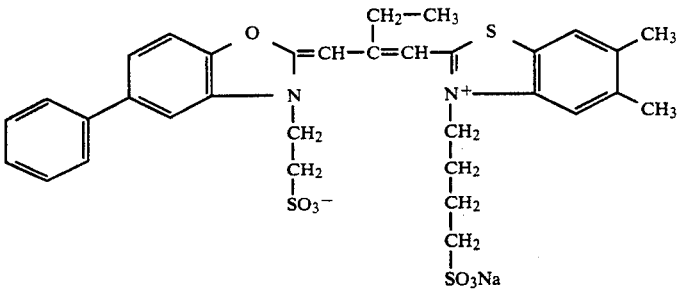

Sensitizing Dye VI

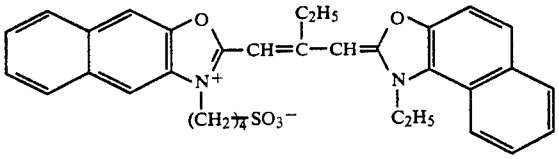

Sensitizing Dye VII

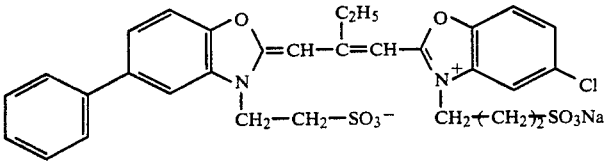

Sensitizing Dye VIII

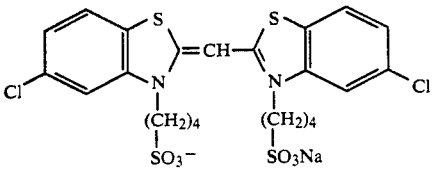

Sensitizing Dye IX

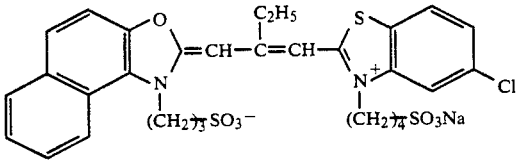

S-1

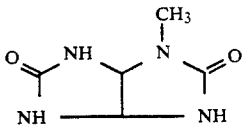

S-2

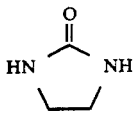

H-1

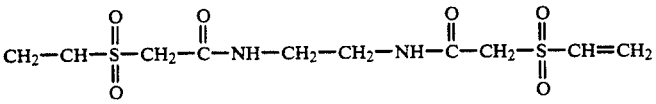

| Emulsion | Average AgI Content (%) | Average Grain Size (μm) | Variation Coefficient of Grain Size (%) | Diameter/ Thickness | Remarks |
|---|---|---|---|---|---|
| A | 4.3 | 0.45 | 27 | 1/1 | Grains had a triple layer structure with a core/intermediate/shell silver ratio of 8/16/76 (AgI contents 0/27/0) |
| B | 8.7 | 0.70 | 14 | 1/1 | As above |
| C | 10 | 0.75 | 30 | 2/1 | Grains had a double layer structure with a core/shell silver ratio of ½ |

-continued

| Emulsion | Average AgI Content (%) | Average Grain Size (μm) | Variation Coefficient of Grain Size (%) | Diameter/ Thickness | Remarks |
|---|---|---|---|---|---|
| | | | | | (AgI contents 24/3) |
| D | 16 | 0.05 | 35 | 2/1 | Grains had a double layer structure with a core/shell silver ratio of ½ (AgI contents 40/0) |
| E | 10 | 1.05 | 35 | 3/1 | Grains had a double layer structure with a core/shell silver ratio of ½ (AgI contents 24/3) |
| F | 4.3 | 0.25 | 28 | 1/1 | Grains had a triple layer structure with a core/intermeidate/shell silver ratio of 8/16/76 (AgI contents 0/27/0) |
| G | 14 | 0.75 | 25 | 2/1 | Grains had a double layer structure with a core/shell silver ratio of ½ (AgI contents 40/0) |
| H | 14 | 1.30 | 25 | 3/1 | Grains had a double layer structure with a core/shell silver ratio of ½ (AgI contents 40/0) |
| I | 1 | 0.07 | 15 | 1/1 | |

EXAMPLE 3

A color photosensitive material was prepared by coating the photosensitive layer consisting of the first to seventh layers indicated below onto a paper support which had been laminated on both sides with polyethylene. Titanium dioxide and a trace amount of ultramarine were included in the polyethylene on the side on which the first layer was coated.

Photosensitive Layer Structure:

The amount of each component shows the amount coated in units of grams per square meter, and in the case of the silver halides the coated weight is shown after calculated as silver.

| | | |
|---|---|---|
| First Layer: Blue-Sensitive Layer | | |
| Silver chlorobromide emulsion (AgBr 80 mol %) | as silver | 0.30 |
| Yellow coupler (*1) | | 0.70 |
| Solvent for the above (TNP) | | 0.15 |
| Gelatin | | 1.20 |
| Second Layer: Intermediate Layer | | |
| Gelatin | | 0.90 |
| EX-5 (same as that used in Example 1) | | 0.05 |
| Solvent for the above (DBP) | | 0.10 |
| Third Layer: Green-Sensitive Layer | | |
| Silver chlorobromide emulsion (AgBr 70 mole %) | as silver | 0.25 |
| Magenta coupler (*2) | | 0.50 |
| Solvent for the above (TOP) | | 0.44 |
| Anti-color fading agent (*3/*4) | | 0.20/0.10 |
| Gelatin | | 1.00 |
| Fourth Layer: Ultraviolet Absorbing Intermediate Layer | | |
| Ultraviolet absorber (*5/*6/*7) | | 0.06/0.25/0.25 |
| Solvent for the above (TNP) | | 0.20 |
| Gelatin | | 1.5 |
| Fifth Layer: Red-Sensitive Layer | | |
| Silver chlorobromide emulsion (AgBr 50 mol %) | as silver | 0.20 |
| Cyan coupler (*8/*9) | | 0.2/0.2 |
| Coupler solvent (TNP/DBP) | | 0.10/0.20 |
| Gelatin | | 0.9 |
| Sixth Layer: Ultraviolet Absorbing Intermediate Layer | | |
| Ultraviolet absorber (*5/*6/*7) | | 0.06/0.25/0.25 |
| Solvent for the above (DBP) | | 0.20 |
| Gelatin | | 1.5 |
| Seventh Layer: Protective layer | | |
| Gelatin | | 1.5 |

Here, DBP signifies dibutyl phthalate, TOP signifies tri-(n-octyl) phosphate and TNP signifies tri(n-nonyl) phosphate.

-continued (*1)

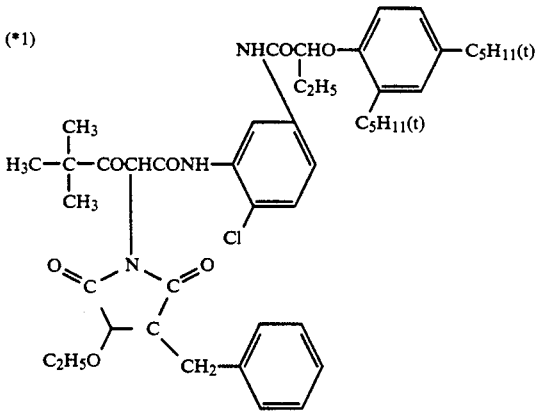

(*2)

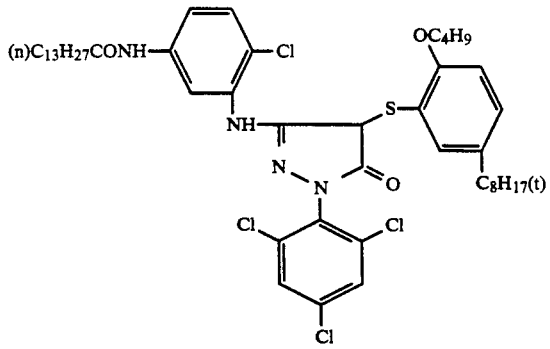

(*3)

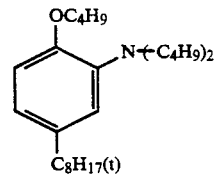

-continued (*4)

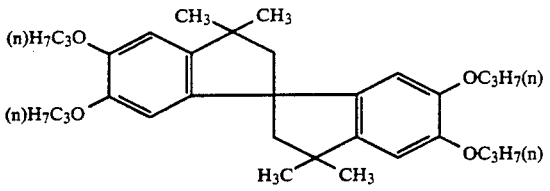

(*5)

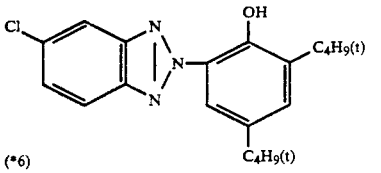

(*6)

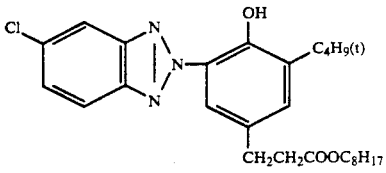

(*7)

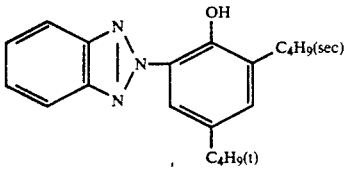

(*8)

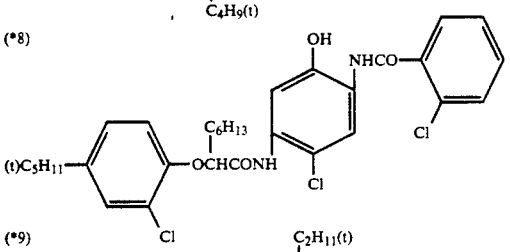

(*9)

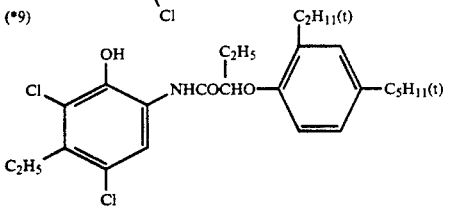

The following dyes were used as spectral sensitizers in each emulsion layer.

Blue-Sensitive Emulsion Layer

4-{5-Chloro-2-[5-chloro-3-(4-sulfonatobutyl)benzothiazolin-2-ylidenemethyl]-3-benzothiazolio}butanesulfonate, triethylammonium salt ($2\times10^{-4}$ mol per mol of silver halide)

Green-Sensitive Emulsion Layer 3,3'-Di(γ-sulfopropyl)-5,5'-diphenyl-9-ethyloxacarbocyanine, sodium salt ($2.5\times10^{-4}$ mol per mol of silver halide)

Red-Sensitive Emulsion Layer 3,3'-Di(γ-sulfopropyl)-9-methylthiadicarbocyanine, sodium salt ($2.5\times10^{-4}$ mol per mol of silver halide)

The following dyes were used in each emulsion layer as anti-irradiation dyes.

Green-Sensitive Emulsion Layer:

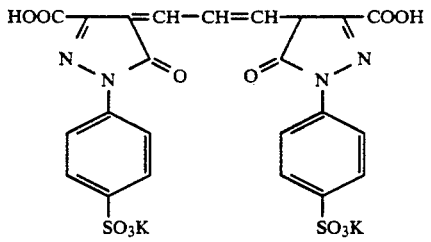

Red-Sensitive Emulsion Layer:

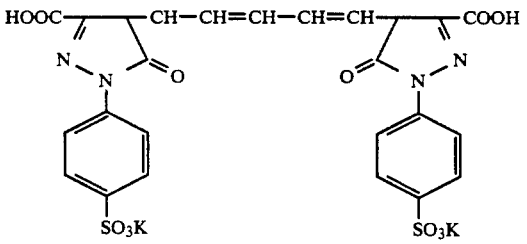

This photosensitive material was sample 301.

Six types of photosensitive material, samples 302 to 307, were then prepared in just the same way except that the EX-5 included in the second layer of sample 301 was replaced as shown in Table 3. These samples were subjected to a graded exposure for sensitometric purposes using an enlarger (Fuji Color Head 609, made by the Fuji Photo Film Co., Ltd.) and then the samples were developed and processed using the processing conditions indicated below.

| Processing Operation | Temperature (°C.) | Time (minutes) |
|---|---|---|
| Development Bath | 33 | 3.5 |
| Bleach-Fix Bath | 33 | 1.5 |
| Water Wash | 28–35 | 3.0 |

| | |
|---|---|
| Development Bath | |
| Nitrilotriacetic acid trisodium salt | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N-ethyl-N-[β-methanesulfonamido)ethyl]-p-phenylenediamine sulfate | 5.0 g |
| $Na_2CO_3$ (monohydrate) | 30 g |
| Water to make | 1 liter |
| pH | 10.1 |
| Bleach-Fix Bath | |
| Ammonium thiosulfate (54 wt %) | 150 ml |
| $Na_2SO_3$ | 15 g |
| $NH_4$[Fe(EDTA)] | 55 g |
| EDTA.2Na | 4 g |
| Water to make | 1 liter |
| pH | 6.9 |

The difference between the magenta density at the maximum yellow density and the magenta density at the minimum yellow density was obtained for each of the strips so obtained to investigate the magenta color turbidity of the yellow parts, and the results obtained were as shown in Table 3.

The compounds of this invention clearly had a superior ability to prevent color turbidity and a satisfactory effect could be achieved with the addition of small amounts.

TABLE 3

| Sample No. | Compound | Amount Added (mol/m$^2$) | Color Turbidity |
|---|---|---|---|
| 301 (Comparison) | EX-5 | $1.5 \times 10^{-4}$ | 0.25 |
| 302 (Invention) | 25 | " | 0.18 |
| 303 (Invention) | 5 | " | 0.18 |
| 304 (Invention) | 4 | " | 0.17 |
| 305 (Invention) | 4 | $7.5 \times 10^{-5}$ | 0.23 |

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer sensitive to red light containing a cyan coupler; at least one silver halide emulsion layer sensitive to green light containing a magenta coupler; at least one silver halide emulsion layer sensitive to blue light containing a yellow coupler; at least one non-light-sensitive layer; and in said non-light-sensitive layer at least one nondiffusible, non-color-forming compound represented by formula (I):

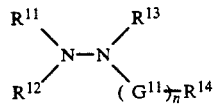

(I)

wherein $R^{11}$, $R^{12}$, and $R^{13}$, which may be the same or different, each represents hydrogen, an aliphatic group or an aromatic group; $R^{14}$ represents hydrogen, an alkyl group, an aryl group, a heterocyclic group, an alkoxy group, an aryloxy group, an amino group, an alkoxycarbonyl group, an aryloxycarbonyl group or a carbamoyl group; $G^{11}$ represents a carbonyl group, a sulfonyl group, a sulfinyl group, a

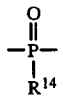

group, or an iminomethylene group;

and n is 0 or 1, wherein (1) the non-color-forming compound of formula (I) does not have residual groups which couple with the oxidized form of a primary aromatic amine developing agent and form a colored or colorless dye, and (2) the $R^{11}$, $R^{12}$, $R^{13}$, $R^{14}$, and $G^{11}$ groups of the non-color-forming compound of formula (I) are not redox residual groups which undergo a redox reaction with an oxidized form of a primary aromatic amine developing agent, and wherein the molecular weight of the non-color-forming compound of formula (I) per N-N unit is at least 400 but not more than 1,200.

2. The silver halide color photographic material as claimed in claim 1, wherein said aromatic group represented by $R^{11}$, $R^{12}$ and $R^{13}$ is a substituted or unsubstituted phenyl group.

3. The silver halide color photographic material as claimed in claim 1, wherein said compound represented by formula (I) has a molecular weight of from 500 to 800.

4. The silver halide color photographic material as claimed in claim 1, wherein said non-light-sensitive layer is an intermediate layer between two light-sensitive layers containing from 0.4 to 1.0 g of gelatin per square meter of said material and said compound represented by formula (I) is present in an amount of from 0.001 to 0.8 g per square meter thereof.

5. The silver halide color photographic material as claimed in claim 4, wherein said compound represented by formula (I) is present in an amount of from about 0.01 to 0.3 g per square meter of said material.

6. A silver halide color photographic material comprising a support having thereon at least one silver halide emulsion layer sensitive to red light containing a cyan coupler; at least one silver halide emulsion layer sensitive to green light containing a magenta coupler; at least one silver halide emulsion layer sensitive to blue light containing a yellow coupler; at least one non-light-sensitive layer; and in said non-light-sensitive layer at least one nondiffusible, non-color-forming compound represented by formula (II):

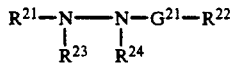

(II)

wherein $R^{21}$ represents an aliphatic group, an aromatic group or a heterocyclic group; $R^{22}$ represents hydrogen, an alkyl group, an aryl group, an alkoxy group, an aryloxy group or an amino group; $G^{21}$ represents a carbonyl group, a sulfonyl group, a sulfinyl group, a

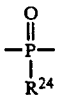

group or an iminomethylene group; at least one of $R^{23}$ and $R^{24}$ represents hydrogen and the other represents hydrogen or an alkylsulfonyl group, an arylsulfonyl group or an acyl group, wherein (1) the non-color-forming compound of formula (II) does not have residual groups which couple with the oxidized form of a primary aromatic amine developing agent and form a colored or colorless dye, and (2) the $R^{21}$, $R^{22}$, $R^{23}$, $R^{24}$, and $G^{21}$ groups of the non-color-forming compound of formula (II) are not redox residual groups which undergo a redox reaction with an oxidized form of a primary aromatic amine developing agent, and wherein the molecular weight of the non-color-forming compound of formula (II) per N-N unit is at least 400 but not more than 1,200.

7. The silver halide color photographic material as claimed in claim 6, wherein said aliphatic group, aromatic group or heterocyclic group represented by $R^{21}$ is substituted with a substituent selected from a ureido group, an alkoxy group, an alkyl group, a substituted amino group, a urethane group, an aryloxy group and a hydroxyl group.

8. The silver halide color photographic material as claimed in claim 7, wherein in formula (II) the moiety represented by $-G^{21}-R^{22}$ is selected from the group consisting of a formyl group, an acyl group, an alkylsulfonyl group, an arylsulfonyl group, an alkylsulfinyl group, an arylsulfinyl group, a carbamoyl group, a sulfamoyl group, an alkoxycarbonyl group, an aryloxycarbonyl group, a sulfinamoyl group, and an alkoxysulfonyl group.

9. The silver halide color photographic material as claimed in claim 8, wherein said group represented by $-G^{21}-R^{22}$ is a formyl group or an acyl group.

10. The silver halide color photographic material as claimed in claim 6, wherein $R^{21}$ represents an aryl group, an aromatic heterocyclic group, or a methyl group substituted with an aryl group; $R^{22}$ represents hydrogen or an alkyl group; $R^{23}$ and $R^{24}$ each represents hydrogen, an unsubstituted phenylsulfonyl group, a substituted phenylsulfonyl group in which the sum of the Hammett substituent constants is at least $-0.5$; an unsubstituted benzoyl group; a substituted benzoyl group in which the sum of the Hammett substituent constants is at least $-0.5$; an unsubstituted aliphatic acyl group; or a substituted aliphatic acyl group substituted with a substituent selected from a halogen atom, an ether group, a sulfonamido group, a carbonamido group, a hydroxyl group, a carboxyl group and a sulfonic acid group.

11. The silver halide color photographic material as claimed in claim 10, wherein $R^{21}$ represents an aryl group; $R^{22}$ represents hydrogen; $R^{23}$ and $R^{24}$ each represents hydrogen.

12. The silver halide color photographic material as claimed in claim 6, wherein the aliphatic group, aromatic group or heterocyclic group represented by $R^{21}$ comprises at least one group selected from a ballast group and a group capable of adsorbing to silver halide.

13. A silver halide color photographic material comprising a support having thereon at least one silver halide emulsion layer sensitive to red light containing a cyan coupler; at least one silver halide emulsion layer sensitive to green light containing a magenta coupler; at least one silver halide emulsion layer sensitive to blue light containing a yellow coupler; at least one non-light-sensitive layer; and in said non-light-sensitive layer at least one nondiffusible, non-color-forming compound represented by formula (III):

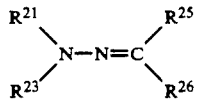

(III)

wherein $R^{21}$ represents an aliphatic group, an aromatic group or a heterocyclic group; $R^{23}$ represents hydrogen, an alkylsulfonyl group, an arylsulfonyl group or an acyl group; $R^{25}$ represents an alkyl group, an aryl group or a heterocyclic group; and $R^{26}$ represents hydrogen, an alkyl group, an aryl group or a heterocyclic group, wherein (1) the non-color-forming compound of formula (III) does not have residual groups which couple with the oxidized form of a primary aromatic amine developing agent and form a colored or colorless dye, and (2) the $R^{21}$, $R^{22}$, $R^{23}$, and $R^{24}$ groups of the non-color-forming compound of formula (III) are not redox residual groups which undergo a redox reaction with an oxidized form of a primary aromatic amine developing agent, and wherein the molecular weight of the non-color-forming compound of formula (III) per N-N unit is at least 400 but not more than 1,200.

* * * * *

UNITED STATES PATENT AND TRADEMARK OFFICE

CERTIFICATE OF CORRECTION

PATENT NO. : 5,230,992

DATED : July 27, 1993

INVENTOR(S) : Keiji Mihayashi and Morio Yagihara

It is certified that error appears in the above-indentified patent and that said Letters Patent is hereby corrected as shown below:

On the title page, under item [19] and item [75], change "Miyahashi" to --Mihayashi--.

Signed and Sealed this

Twenty-third Day of August, 1994

*Attest:*

*Attesting Officer*

BRUCE LEHMAN

*Commissioner of Patents and Trademarks*